US007939231B2

(12) United States Patent
Ogawa et al.

(10) Patent No.: US 7,939,231 B2
(45) Date of Patent: May 10, 2011

(54) MAGNETIC TONER

(75) Inventors: Yoshihiro Ogawa, Numazu (JP); Yusuke Hasegawa, Suntoh-gun (JP); Shinichiro Abe, Toride (JP); Junko Nishiyama, Suntoh-gun (JP); Takashige Kasuya, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 924 days.

(21) Appl. No.: 11/817,295

(22) PCT Filed: Jun. 24, 2005

(86) PCT No.: PCT/JP2005/012158

§ 371 (c)(1),
(2), (4) Date: Aug. 28, 2007

(87) PCT Pub. No.: WO2006/114900

PCT Pub. Date: Nov. 2, 2006

(65) Prior Publication Data

US 2009/0035679 A1 Feb. 5, 2009

(30) Foreign Application Priority Data

Apr. 22, 2005 (JP) ..... 2005-124700

(51) Int. Cl.
*G03G 9/08* (2006.01)

(52) U.S. Cl. ..... 430/106.2; 430/109.4; 430/111.41

(58) Field of Classification Search ..... 430/106.2, 430/109.4, 111.41
See application file for complete search history.

(56) References Cited

U.S. PATENT DOCUMENTS

| | | | | |
|---|---|---|---|---|
| 5,814,429 | A | 9/1998 | Kawakami et al. | 430/124 |
| 5,853,937 | A | 12/1998 | Asanae et al. | 430/106.6 |
| 5,912,101 | A | 6/1999 | Karaki et al. | 430/110 |
| 5,976,752 | A | 11/1999 | Matsunaga et al. | 430/110 |
| 6,033,817 | A | 3/2000 | Yusa et al. | 430/106.6 |
| 6,346,070 | B1 | 2/2002 | Ohmatsuzawa et al. | 529/279 |
| 6,451,959 | B1 | 9/2002 | Ohmatsuzawa et al. | 528/279 |
| 6,485,875 | B1 | 11/2002 | Karaki et al. | 430/108.23 |
| 7,043,175 | B2 | 5/2006 | Komoto et al. | 399/159 |
| 7,049,041 | B2 * | 5/2006 | Kishiki et al. | 430/109.4 |
| 7,160,660 | B2 | 1/2007 | Dojo et al. | 430/106.1 |
| 7,273,686 | B2 * | 9/2007 | Onuma et al. | 430/110.3 |
| 7,422,832 | B2 | 9/2008 | Ogawa et al. | 430/106.2 |
| 7,648,812 | B2 * | 1/2010 | Umehara | 430/108.21 |
| 2003/0235772 | A1 | 12/2003 | Ogawa et al. | 430/107.1 |
| 2005/0026060 | A1 * | 2/2005 | Ogawa et al. | 430/106.1 |

(Continued)

FOREIGN PATENT DOCUMENTS

EP 0 415 727 A2 3/1991

(Continued)

OTHER PUBLICATIONS

Leibler, L., "Phenol-Formaldehyde Resins," *Encyclopedia of Polymer Science and Engineering*, vol. 11, 45-95 (1988).

*Primary Examiner* — Mark A Chapman
(74) *Attorney, Agent, or Firm* — Fitzpatrick, Cella, Harper & Scinto

(57) ABSTRACT

A magnetic toner is disclosed having magnetic toner particles containing a binder resin and a magnetic iron oxide. The magnetic toner has a specific saturation magnetization and a specific residual magnetization in ascertain magnetic field. The binder resin includes a polyester component polymerized with an aromatic carboxylic acid titanium compound as a catalyst.

6 Claims, 2 Drawing Sheets

U.S. PATENT DOCUMENTS

| | | | | |
|---|---|---|---|---|
| 2006/0063082 | A1* | 3/2006 | Mikuriya et al. | 430/108.3 |
| 2007/0202424 | A1 | 8/2007 | Ogawa et al. | 430/106.1 |

FOREIGN PATENT DOCUMENTS

| | | |
|---|---|---|
| EP | 1503249 | 2/2005 |
| JP | 63-043740 | 9/1988 |
| JP | 02-087157 | 3/1990 |
| JP | 03-084558 | 4/1991 |
| JP | 03-229268 | 10/1991 |
| JP | 04-001766 | 1/1992 |
| JP | 04-102862 | 4/1992 |
| JP | 05-279465 | 10/1993 |
| JP | 06-317928 | 11/1994 |
| JP | 09-090670 | 4/1997 |
| JP | 09-146297 | 6/1997 |
| JP | 09-179342 | 7/1997 |
| JP | 10-097095 | 4/1998 |
| JP | 10-171150 | 6/1998 |
| JP | 11-149176 | 6/1999 |
| JP | 11-202557 | 7/1999 |
| JP | 3033614 | 2/2000 |
| JP | 2000-338707 | 12/2000 |
| JP | 2001-064378 | 3/2001 |
| JP | 2002-148867 | 5/2002 |
| JP | 2002-214829 | 7/2002 |
| JP | 2004-029160 | 1/2004 |
| JP | 2005-062797 | 3/2005 |
| JP | 2005-070756 | 3/2005 |
| JP | 2005-091525 | 4/2005 |
| JP | 2005-091883 | 4/2005 |
| KR | 20050014638 | 2/2005 |

* cited by examiner

MAGNETIC TONER

TECHNICAL FIELD

The present invention relates to a toner to be used in an image forming method such as an electrophotographic method, an electrostatic printing method, a magnetic recording method or a toner jet method.

RELATED BACKGROUND ART

Various toners have been proposed to satisfy a fixing property and a resistance to high-temperature offset of the toner at the same time. In particular, a toner utilizing a binder resin including a polyester component superior in the fixing property and the high-temperature offset resistance, is used in an apparatus requiring a high fixing ability such as a high-speed apparatus. However, such a binder resin including a polyester component leads to various drawbacks in a magnetic toner.

In the case of polyester resin unlike vinyl resin, it is difficult to form a straight chain polymer component with a large molecular weight, it is required to provide the binder resin with a crosslinking structure such as a gel component, and to form a structure capable of avoiding high-temperature offset, which is generated by reduction in the resin viscosity at a high temperature region.

However, such a binder resin having a gel component, when used in a toner, tends to deteriorate a crushing property of the toner. Where crushing is executed under relatively vigorous conditions, the magnetic iron oxide tends to be liberated from the toner particles by an impact in the crushing process. The liberated magnetic iron oxide adversely affects the charging property of the toner, and tends to cause a decrease in the image density or fog. On the other hand, in order to achieve a uniform dispersion under increased adhesion with the binder resin for avoiding the liberation of the magnetic iron oxide, kneading is required to be conducted at high temperature at which the binder resin is sufficiently melted. However, such kneading operation leads to a reduced melt viscosity of the kneaded substance, thus lowering the dispersion of materials other than the magnetic iron oxide and deteriorating the developing property.

Also, the crushing operation under strong impact tends to generate fine toner particles of a very small particle size, called ultra fine powder. Such ultra fine powder deteriorates the charge stability of the toner, thus increasing fog and increasing a sleeve ghost phenomenon.

Such drawbacks become more conspicuous when intending to improve performances such as a higher process speed, a longer service life and a higher image quality by the use of finer toner particles.

As a polymerization catalyst for producing a polyester resin for the toner, a tin-based catalyst has generally been used such as dibutyl tin oxide or dioctyl tin oxide, or an antimony-based catalyst such as antimony trioxide. However, such polymerization catalysts are being investigated further in order to satisfy performance of the magnetic toner suitable for a higher process speed and a higher image quality.

A technology of utilizing a titanic acid ester of an aromatic diol or a solid titanium compound is disclosed as a polymerization catalyst. (For example, see Japanese Patent Application Laid-open No. 2002-148867 and Japanese Patent Application Laid-open No. 2001-64378.)

Also, a technology of employing, as a condensation polymerization catalyst for polyester resin, a titanium tetralkoxide treated with an organic monocarboxylic acid is disclosed. (For example, see Japanese Patent Application Laid-open No. H05-279465.)

However, mere polymerization of a polyester component with such a titanium compound as a polymerization catalyst is not sufficient for improving the adhesion between the magnetic iron oxide and the binder resin.

Also in a one-component developing method with a magnetic toner, advantageously used in the development of electrophotography, a magnetic property and a charging property of the magnetic toner significantly influences the image quality. Particularly in a case where employing a binder resin containing a polyester component, it is necessary to comprehensively control the dispersibility of magnetic iron oxide and the magnetic property of the magnetic toner.

As for the magnetic property of toner, various technologies have been disclosed. (See, for example, Japanese Registered Patent No. 3033614; Japanese Patent Application Laid-open No. H066-317928; Japanese Patent Application Laid-open No. H09-090670; Japanese Patent Application Laid-open No. H09-146297; Japanese Patent Application Laid-open No. H10-171150; Japanese Patent Application Laid-open No. 2002-214829; and Japanese Patent Publication No. S63-043740.)

However, the correlation among the polymerization catalyst for the polyester component, the magnetic property of the toner and the magnetic iron oxide has not been investigated sufficiently and there is a room for improvement.

For the purpose of improving a low-temperature fixing property and a fixing property in a wide fixing temperature range, it is proposed to provide Fischer-Tropsch wax with a polar group thereby achieving improvements in a low-temperature fixing property, a fixing strength and a mutual solubility with the binder resin (for example, see Japanese Patent Application Laid-open No. H09-179342). It is also proposed to include a certain alcoholic wax to secure an appropriate mutual solubility with the binder resin and a wide fixing temperature range (for example, Japanese Patent Application Laid-open No. 2000-338707; and Japanese Patent Application Laid-open No. 2004-029160). However, a relationship between the binder resin and the polar group of wax has not been investigated in consideration of the environmental stability, in addition to the excellent fixing property.

A technology is disclosed for obtaining a toner shape close to a spherical shape by a manufacturing method such as spray granulation, dissolution in a solution or polymerization. (See, for example, Japanese Patent Application Laid-open No. H03-084558; Patent Literature 15: Japanese Patent Application Laid-open No. H03-229268; Japanese Patent Application Laid-open No. H04-001766 and Japanese Patent Application Laid-open No. H04-102862.)

A technology is disclosed for modifying the shape and the surface property of particles by thermal or mechanical impact on the toner produced by a crushing method. (See, for example, Japanese Patent Application Laid-open No. H02-087157; Japanese Patent Application Laid-open No. H10-097095; Japanese Patent Application Laid-open No. H11-149176; and Patent Literature 21: Japanese Patent Application Laid-open No. H11-202557.)

However, with mere modification of the toner shape by such methods, it is difficult to obtain a magnetic toner utilizing a polyester resin capable of providing high image quality.

DISCLOSURE OF THE INVENTION

An object of the present invention is to provide a toner excellent in a fixing property and a high-temperature offset resistance.

Another object of the present invention is to provide a toner capable of maintaining a high image density regardless of the use environment and excellent in a dot reproducibility without fog or a sleeve ghost.

The present invention provides a magnetic toner having magnetic toner particles containing at least a binder resin and a magnetic iron oxide, wherein the magnetic toner has a saturation magnetization as of 5-80 $Am^2/kg$ and a residual magnetization Or of 0.1-15.0 $Am^2/kg$ in a measuring magnetic field of 795.8 kA/m, and the binder resin includes at least a polyester component polymerized with an aromatic carboxylic acid titanium compound as a catalyst.

The present invention also provides a toner in which the aromatic carboxylic acid titanium compound is obtained by reacting an aromatic carboxylic acid and a titanium alkoxide.

The present invention also provides a toner in which the aromatic carboxylic acid is an aromatic carboxylic acid and/or an aromatic oxycarboxylic acid with two or more valences.

The present invention also provides a toner in which the titanium alkoxide is a compound represented by a general formula (I):

general formula (1)

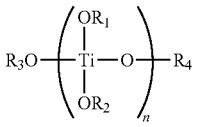

wherein $R_1$, $R_2$, $R_3$ and $R_4$ represent alkyl groups with 1-20 carbon atoms, which may be same or different and each may have a substituent; and n represents an integer of 1 to 10.

The present invention also provides a toner in which the polyester component is one obtained by polycondensation of a dihydric or higher polyhydric alcohol and a dicarboxylic or higher polycarboxylic, and contains an aromatic dicarboxylic acid in an amount of 50 mol. % or more based on all the carboxylic acid components.

The present invention also provides a toner in which the magnetic toner has, in particles having a circle-equivalent diameter of 3 to 400 μm in measurement with a flow-type particle image measuring apparatus, an average circularity equal to or higher than 0.935 but less than 0.995 and an average surface roughness equal to or higher than 10.0 nm but less than 26.0 nm in measurement with a scanning probe microscope.

According to the present invention, a toner is provided which is excellent in a fixing property and a high-temperature offset resistance, and is capable of maintaining a high image density regardless of the use environment and excellent in a dot reproducibility without fog or a sleeve ghost.

DESCRIPTION OF THE PREFERRED EMBODIMENTS

Figure 1:
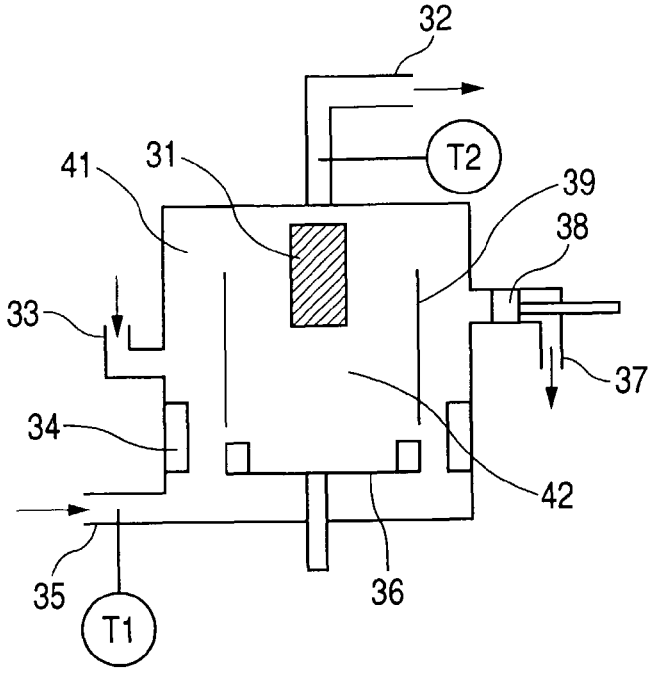
FIG. 1 is a schematic cross-sectional view of a sphering apparatus used in a sphering step of the present invention.

In the present invention, a resin including a polyester component polymerized with an aromatic carboxylic acid titanium compound uniformly contains the titanium compound in the resin. Such titanium compound, having affinity with the binder resin and the magnetic iron oxide, is found to be effective in drastically improving the dispersibility of the magnetic iron oxide in the toner and the adhesion to the binder resin.

This mechanism, though not fully clarified yet, is estimated as follows. The aromatic carboxylic acid titanium compound, not easily deactivated as catalyst by moisture, does not lose activity by water generated in esterification reaction and remains in a larger amount as the aromatic carboxylic acid titanium compound in the polyester component. Therefore, in the titanium compound, the aromatic carboxylic acid portion has affinity with the polyester component while a titanium portion has affinity with the magnetic iron oxide, thereby serving as a dispersant for uniformly dispersing the magnetic iron oxide in the polyester component. As a result, the titanium compound exerts effects of preventing liberation of magnetic iron oxide from the toner particle surface and of uniformly dispersing the magnetic iron oxide in the toner particles.

On the other hand, a titanium catalyst which is easily deactivated moisture, changes to titanium oxide and the like by deactivation, thus being unable to function as a dispersant. Also in the case of a deactivation of the catalyst in the course of polymerization, the catalyst with activity is unevenly distributed in the polyester component and the polymerization degree tends to become higher in a peripheral portion where the catalyst activity remains. As a result, the polymerization degree decreases in an area lower in catalyst activity, and a portion higher in viscosity and a portion lower in viscosity are mixed in the polyester component.

Particularly in the case where an ultra high polymer such as a gel component is generated, a hard gel component with a low molecular weight between crosslinking points tends to be generated due to local generation of the gel component. Also around a site where the catalyst has been deactivated, the polymerization does not proceed and the viscosity remains low, so that a polyester component results in which a very hard gel component is localized in a low molecular component of a low viscosity.

When such a resin is used in the toner, the toner materials such as magnetic iron oxide or wax cannot easily be incorporated into the gel component and remain localized in the toner, thus deteriorating the charge stability. In addition, due to the unevenness of the viscosity of the resin, an ultra fine powder tends to be generated in the crushing operation to deteriorate the charge stability of the toner, thus resulting in a lowering in image density, an increase in fog and an increase in sleeve ghosts.

When using the aromatic carboxylic acid titanium compound of the invention as the catalyst, the catalyst is not easily deactivated, thus the polymerization degree is uniformly elevated in the entire polyester component, whereby the polyester component without unevenness of the viscosity can be obtained. Also in the case where a gel component is included in the resin, a soft gel component with a large molecular weight between the crosslinking points can be obtained since local generation of the gel component does not take place. Consequently the toner materials such as magnetic iron oxide or wax can be uniformly dispersed and the ultra fine powder is not much generated, whereby an excellent charging property can be attained.

A soft gel component with a large molecular weight between the crosslinking points can achieve a low melt viscosity in a low-temperature range and a high elasticity at a high-temperature range at the same time, thereby realizing an excellent fixing property and high-temperature offset resistance at the same time.

Particularly in the case where the toner employing the resin including the polyester component polymerized by using an aromatic carboxylic acid titanium compound as a catalyst has, in a magnetic field of 795.8 kA/m, magnetic properties of a saturation magnetization σs of 5-80 $Am^2/kg$ (preferably 10-70 $Am^2/kg$ and more preferably 20-50 $Am^2/kg$) and a residual magnetization σr of 0.1-15.0 $Am^2/kg$ (preferably 0.5-12.0 $Am^2/kg$ and more preferably 1.0-10.0 $Am^2/kg$), a state is attained such that the magnetic binding force of the toner to a developing sleeve and a charge amount of the toner are highly balanced thereby stabilizing a coating property of the toner on the developing sleeve and a charging property of the toner on the developing sleeve. It is thus rendered possible to improve the stability of the image density in continuous running and the environmental stability, and to prevent the fog and sleeve ghosts from occurring.

A saturation magnetization σs less than 5 $Am^2/kg$ results in excessively small magnetic force of the toner, eventually deteriorating the coating property on the developing sleeve, thus aggravating the fog and the sleeve ghost. A saturation magnetization σs exceeding 80 $Am^2/kg$ results in excessively large magnetic binding force of the toner to the developing sleeve, thus tending to deteriorate the developing property.

A residual magnetization σr less than 0.1 $Am^2/kg$ weakens attractive force on the toner to the developing sleeve, and, particularly in jumping development, decreases force of pulling the toner deposited on a photosensitive drum back to the developing sleeve, thereby increasing the fog. A residual magnetization σr exceeding 15.0 $Am^2/kg$ results in excessively strong force of pulling the toner deposited on a photosensitive drum back to the developing sleeve, thereby causing a low image density, or worsens the circulation of the toner in the developing device because the toner coated on the developing sleeve is not easily separated, thereby leading to a charge-up phenomenon.

The aromatic carboxylic acid titanium compound to be used in the invention may be a titanium aromatic monocarboxylate such as titanium benzoate; a titanium aromatic dicarboxylate such as titanium phthalate, titanium terephthalate, titanium isophthalate, titanium 1,3-naphthalenedicarboxylate, titanium 4,4-biphenyldicarboxylate, titanium 2,5-toluenedicarboxylate or titanium anthracenedicarboxylate; a titanium aromatic tricarboxylate such as titanium trimellitate, or titanium 2,4,6-naphthalenetricarboxylate; a titanium aromatic polycarboxylate such as titanium pyromellitate or titanium 2,3,4,6-naphthalenecarboxylate; a titanyl aromatic monocarboxylate such as titanyl benzoate; a titanyl aromatic dicarboxylate such as titanyl phthalate, titanyl terephthalate, titanyl isophthalate, titanyl 1,3-naphthalenedicarboxylate, titanyl 4,4-biphenyldicarboxylate, titanyl 2,5-toluenedicarboxylate or titanyl anthracenedicarboxylate; a titanyl aromatic tricarboxylate such as titanyl trimellitate, or titanyl 2,4,6-naphthalenetricarboxylate; a titanyl aromatic polycarboxylate such as titanyl pyromellitate or titanyl 2,3,4,6-naphthalenecarboxylate; or an alkali metal salt or an alkali earth metal salt of such a titanyl aromatic carboxylate.

In particular, the aromatic carboxylic acid titanium compound to be used in the invention is preferably a compound obtained by reaction of an aromatic carboxylic acid and a titanium alkoxide. The titanium alkoxide easily reacts with a carboxylic acid or an acid anhydride to form a titanium acylate, and, particularly in the case of employing an aromatic carboxylic acid as the acid, exhibits preferable catalytic activity in esterification reaction and ester exchange reaction.

Since the compound is not easily deactivated by water produced in an esterification reaction, the viscosity of the whole resin uniformly increases and a soft gel component having a large molecular weight between the crosslinking points can be easily produced, thus providing an excellent fixing property and excellent high-temperature offset resistance.

The aromatic carboxylic acid is preferably an aromatic carboxylic acid and/or an aromatic oxycarboxylic acid of two or more valences. An aromatic carboxylic acid and/or an aromatic oxycarboxylic acid of two or more valences increases the affinity between the aromatic carboxylic acid titanium compound and the polyester component, thereby elevating the adhesion between the binder resin and the magnetic iron oxide, and improving the dispersibility of the magnetic iron oxide.

Examples of the aromatic carboxylic acid of two or more valences include a dicarboxylic acid and an acid anhydride thereof such as phthalic acid, isophthalic acid or terephthalic acid; a polycarboxylic acid, an acid anhydride and an ester thereof such as trimellitic acid, benzophenonedicarboxylic acid, benzophenonetetracarboxylic acid, naphthalenedicarboxylic acid, or naphthalenetetracarboxylic acid.

Examples of the aromatic oxycarboxylic acid include salicylic acid, m-oxybenzoic acid, p-oxycarboxylic acid, gallic acid, mandelic acid, and tropic acid.

Among these, isophthalic acid, terephthalic acid, trimellitic acid and naphthalenedicarboxylic acid are preferred.

As the titanium alkoxide, a compound of a general formula (1) is preferably used as it can provide a binder resin excellent in a fixing property and a high-temperature offset resistance.

general formula (1)

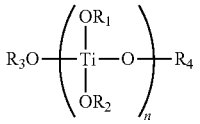

wherein $R_1$, $R_2$, $R_3$ and $R_4$ represent alkyl groups with 1-20 carbon atoms, which may be the same or different and each may have a substituent; and n represents an integer of 1 to 10.

Each of $R_1$, $R_2$, $R_3$ and $R_4$ preferably represents an alkyl group with 1 to 10 carbon atoms, such as titanium tetramethoxide, titanium tetraethoxide, titanium tetra-i-propoxide, titanium tetra-n-propoxide, titanium tetra-i-butoxide, titanium tetra-n-butoxide, titanium tetrapentyl oxide, titanium tetrahexyl oxide, titanium tetraheptyl oxide, titanium tetraoctyl oxide, titanium tetranonyl oxide or titanium tetradecyl oxide.

The preferable compound represented by the general formula (1) is a polytitanate ester with n of 2 to 10, more specifically such as tetra-n-butyl polytitanate, tetra-n-hexyl polytitanate or tetra-n-octyl polytitanate.

The addition amount of the aromatic carboxylic acid titanium compound is 0.001 to 5 wt. % to the polyester monomer, preferably 0.005 to 3 wt. % and more preferably 0.01 to 2 wt. %. The amount less than 0.001 wt. % prolongs the reaction time of the polyester polymerization and cannot provide an effect of improving the dispersibility of the magnetic iron oxide. The amount exceeding 2 wt. % affects the charging property of the toner, thus eventually increasing the fluctuation of the charge amount depending upon the environmental conditions.

In the invention, another polymerization catalyst may be used if necessary in combination with the aromatic carboxylic acid titanium compound, where a titanium compound is preferably used in combination. Two or more titanium compounds used in combination as the polymerization catalyst allow the reaction speeds of an esterification reaction and an ester exchange reaction to be balanced at the polymerization of polyester, and make it possible to generate a soft gel component having a large distance between the crosslinking points.

Preferred examples of the titanium compound to be used in combination with the aromatic carboxylic acid titanium compound include a titanium halide such as dichlorotitanium, trichlorotitanium, tetrachlorotitanium, trifluorotitanium or tetrafluorotitanium; a titanium diketonelonate such as titanium acetylacetonate, titanium diisopropoxide bisacetylacetonate, or titanyl acetylacetonate, a titanium aliphatic carboxylate such as titanium formate, titanium acetate, titanium propionate, titanium octoate, titanium oxalate, titanium succinate, titanium maleate, titanium adipate, or titanium sebacate; a titanyl aliphatic carboxylate such as titanyl formate, titanyl acetate, titanyl propionate, titanyl octoate, titanyl oxalate, titanyl succinate, titanyl maleate, titanyl adipate, or titanyl sebacate, and an alkali metal salt and an alkali earth metal salt of such titanyl carboxylate. Among these, titanyl oxalate is particularly preferably used because of its high catalytic activity for the esterification reaction.

An amount of the titanium compound to be used in combination with the aromatic carboxylic acid titanium compound, is preferably 0.001 to 5 wt. % with respect to the polyester monomer.

In the toner of the invention, the following substance may be used, if necessary, as a co-catalyst in addition to the aromatic carboxylic acid titanium compound.

The following may be advantageously used as the co-catalyst: a compound including an element such as beryllium, magnesium, calcium, strontium, barium, zirconium, manganese, cobalt, zinc, boron, aluminum, gallium, phosphor, or tin. As a compound containing such an element, the following is preferably used: an aliphatic acid salt such as an acetate salt of the aforementioned element, a carbonate salt, a sulfate salt, an alkoxide, a halide such as a chloride, an acetylacetonate salt, or an oxide. The following may also be advantageously used a chelate compound with a dicarboxylic acid, a dialcohol or an oxycarboxylic acid, a reaction product of an aromatic diol and an alkoxide, or a reaction product of an organic monocarboxylic acid and an alkoxide.

Among these, the following is preferable: an acetate salt, a carbonate salt, an alkoxide, an alkoxide halide, or an acetylacetonate salt, and a zirconium alkoxide, magnesium carbonate or magnesium acetate is particularly preferable.

Such co-catalyst, used in combination with the aromatic carboxylic acid titanium compound, advantageously promotes the condensation polymerization reaction.

Such co-catalyst is used in an amount within a range of 0.01 to 200 wt. % with respect to the aromatic carboxylic acid titanium compound.

A polyester component used in the invention can be obtained by condensation polymerization of a polyhydric alcohol and a polybasic carboxylic acid. In the invention, for example, polyester components shown in the following may be used.

A dihydric alcohol component may be ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, a hydrogenated bisphenol-A, a bisphenol represented by formula (A) or a derivative thereof, or a diol represented by formula (B):

(A)

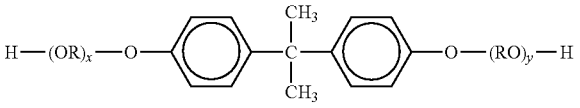

I wherein R represents an ethylene group or a propylene group; x and y each represents an integer equal to or larger than 0, with an average of x+y being 0 to 10.

(B)

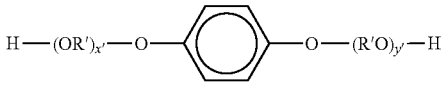

wherein R' represents —$CH_2CH_2$—, —$CH_2$—$CH(CH_3)$— or —$CH_2$—$C(CH_3)_2$—; and x' and y' have an average value within a range of 0-10.

Examples of the dibasic acid component include dicarboxylic acid and derivatives thereof, for example a benzenedicarboxylic acid, an anhydride or a lower alkyl ester thereof such as phthalic acid, terephthalic acid, isophthalic acid or phthalic anhydride; an alkyldicarboxylic acid, an anhydride or a lower alkyl ester thereof such as succinic acid, adipic acid, sebacic acid, or azelaic acid; an alkenylsuccinic acid, an alkylsuccinic acid, an anhydride or a lower alkyl ester thereof such as n-dodecenylsuccinic acid or n-dodecylsuccinic acid; an unsaturated dicarboxylic acid, an anhydride or a lower alkyl ester thereof such as fumaric acid, maleic acid, citraconic acid or itaconic acid.

In particular, an aromatic dicarboxylic acid is preferable as it increases the affinity between the polyester component and the aromatic carboxylic acid titanium compound and facilitates uniform dispersion, thereby improving the adhesion between the magnetic iron oxide and the polyester component.

It is preferable that the carboxylic acid component contains an aromatic dicarboxylic acid in an amount of 50 mol. % or more based on all the carboxylic acid components. The aromatic dicarboxylic acid is used in such a larger amount, thereby further increasing the affinity between the polyester component and the aromatic carboxylic acid titanium compound, and improving the stability of the developing property in continuous running.

It is also preferable to employ, in combination, a trihydric or higher-polyhydric alcohol and a tri- or higher-polycarboxylic acid component which function as crosslinking components.

The trihydric or higher-polyhydric alcohol component may be, for example, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, or 1,3,5-trihydroxybenzene.

A particularly preferred trihydric or higher-polyhydric alcohol component is a compound with a structure containing an oxyalkylene ether of a novolac phenolic resin. Such a compound with a structure containing an oxyalkylene ether of a novolac phenolic resin is a reaction product of a novolac phenolic resin and a compound having an epoxy ring in its molecule, and is provided with three or more terminal alcoholic hydroxyl groups.

A novolac phenolic resin can be synthesized, as described in Encyclopedia of Polymer Science and Technology (Interscience Publishers), vol. 10, p. 1 "phenolic resins", by condensation polymerization of a phenol and an aldehyde in the presence of a catalyst for example an inorganic acid such as hydrochloric acid, phosphoric acid or sulfuric acid, an organic acid such as paratoluenesulfonic acid or oxalic acid, or a metal salt such as zinc acetate.

Phenols may include unsubstituted phenol or substituted phenol having at least a hydrocarbon group with 1-35 carbon atoms and/or a halogen group. Specific examples of the substituted phenol include cresol (o-, m- or p-), ethylphenol, nonylphenol, octylphenyl, phenylphenol, styrenized phenol, isopropenylphenol, 3-chlorophenol, 3-bromophenol, 3,5-xylenol, 2,4-xylenol, 2,6-xylenol, 3,5-dichlorophenol, 2,4-dichlorophenol, 3-chloro-5-methylphenol, dichloroxylenol, dibromoxylenol, 2,4,5-trichlorophenol, and 6-phenyl-2-chlorophenol. Such phenol may be used in a combination of two or more kinds.

Among these, unsubstituted phenol or phenol substituted with a hydrocarbon group is preferable, and phenol, cresol, t-butylphenol or nonylphenol is particularly preferable. Phenol and cresol are preferable in respect of costs and of providing the toner with offset resistance, and the phenol substituted with a hydrocarbon group, represented by t-butylphenol and nonylphenol are preferable in respect of reducing temperature dependence of the charge amount of the toner.

The aldehyde may be formalin (formaldehyde solution of various concentrations), parformaldehyde, trioxane or hexamethylenetetramine.

The novolac phenolic resin generally has a number-averaged molecular weight of 300 to 8,000, preferably 350 to 3,000, and further preferably 400 to 2,000. In the novolac phenolic resin, the average number of phenol nuclei is normally 3 to 60, preferably 3 to 20 and further preferably 4 to 15.

The softening point (JIS K2531, ball and ring method) is normally 40-180° C., preferably 40 to 150° C. and more preferably 50 to 130° C. The softening-point less than 40° C. results in difficulty in handling because of a blocking phenomenon even at a room temperature. The softening point exceeding 180° C. induces gelation in the course of preparation of the polyester component.

Specific examples of a compound having an epoxy ring in its molecule include ethylene oxide (EO), 1,2-propylene oxide (PO), 1,2-butylene oxide, 2,3-butylene oxide, styrene oxide and epichlorohydrin. There can also be utilized a glycidyl ether of an aliphatic monohydric alcohol or a monovalent phenol with 1-20 carbon atoms. Among these, EO and PO are preferable.

The number of moles of the compound having an epoxy ring in its molecule to be added to 1 mole of the novolac phenolic resin is normally 1 to 30 moles, preferably 2 to 15 moles and further preferably. 2.5 to 10 moles, and the number of moles of the compound having an epoxy ring in its molecule to be added to 1 mole of the phenolic hydroxyl group in the novolac phenolic resin is usually 0.1 to 10 moles, preferably 0.1 to 4 moles and further preferably 0.2 to 2 moles.

The oxyalkylene ether compound of novolac phenolic resin, used particularly preferably in the invention, has a structure represented by the following general formula:

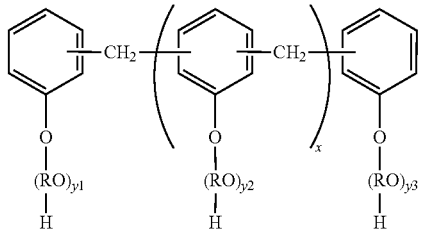

wherein R represents an ethylene or propylene group; x represents an integer equal to or larger than 0; and y1-y3 represent the same or different integers at least one of which is equal to or larger than 1.

The oxyalkylene ether compound of the novolac phenolic resin has a number-average molecular weight of normally 300 to 10,000 preferably 350 to 5,000 and further preferably 450 to 3,000. The number-average molecular weight less than 300 results in insufficient offset resistance, and the number-average molecular weight exceeding 10,000 unfavorably induces a gelation in the course of preparation of the polyester component.

The oxyalkylene ether compound of the novolac phenolic resin has a hydroxyl value (the sum of alcoholic and phenolic hydroxyl groups) of normally 10-550 mgKOH/g, preferably 50-500 mgKOH/g, and further preferably 100-450 mgKOH/g. In such a hydroxyl value, a phenolic hydroxyl value is normally 0-500 mgKOH/g, preferably 0-350 mgKOH/g, and further preferably 5-250 mgKOH/g.

The oxyalkylene ether compound of the novolac phenolic resin may be prepared, for example, in the presence of a catalyst (an acid catalyst or a base catalyst) if necessary, by reacting a compound having an epoxy ring in its molecule with a novolac phenolic resin. The reaction is executed at a temperature of 20-250° C., preferably 70-200° C., and may be executed under a normal pressure, under an increased pressure or a reduced pressure. The reaction can be executed in the presence of at least one of a solvent (such as xylene or dimethylformamide), another dihydric alcohol and a tri- or higher-polyhydric alcohol.

The tri- or higher-polycarboxylic acid component to be used in the invention may be a polycarboxylic acid or a derivative thereof such as pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, enpol trimer acid, or an anhydride or a lower alkyl ester thereof; a tetracarboxylic acid represented by the following general formula, an anhydride or a lower alkyl ester thereof. Among the above, 1,2,4-benzenetricarboxylic acid, 1,2,5-benzenetricarboxylic acid, an anhydride or a lower alkyl ester thereof is preferable.

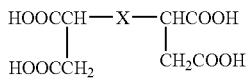

wherein X represents an alkylene or alkenylene group with 5 to 30 carbon atoms having at least a side chain with 3 or more carbon atoms.

In the invention, the alcohol component may account for 40-60 mol. %, preferably 45-55 mol. %, and the acid component may account for 60-40 mol. %, preferably 55-45 mol. %. The tri- or higher-valent component may account for preferably 5-60 mol. % of all the components.

The polyester component can be obtained by ordinarily known condensation polymerization. The polymerization reaction of the polyester component is executed in the presence of the aromatic carboxylic acid titanium compound as a catalyst at a temperature of 150-300° C., preferably 170-280° C. The reaction may be executed under a normal pressure, a reduced pressure or an increased pressure, but it is preferable, after reaching a predetermined reaction rate (for example about 30-90%), to execute the reaction by reducing the pressure of the reaction system to 200 mmHg or less, preferably 25 mmHg or less and more preferably 10 mmHg or less.

The polyester component of the invention can be obtained by terminating the reaction when the property (such as an acid value or a softening point) of the reaction product reaches a predetermined value or when an agitating torque or agitating power of the reactor reaches a predetermined value.

The toner of the invention preferably contains a vinyl polymer component. The presence of such vinyl polymer component enable water adsorption by the polyester component to be controlled, thereby improving the environmental stability of the developing property of the magnetic toner.

Examples of a vinyl monomer of the vinyl polymer component includes styrene; a styrene derivative such as o-methylstyrene, m-methylstyrene, p-methylstyrene, p-phenylstyrene, p-ethylstyrene, 2,4-dimethylstyrene, p-butylstyrene, p-tert-tributylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, or p-nitrostyrene; an unsaturated monoolefin such as ethylene, propylene, butylene or isobutylene; an unsaturated polyene such as butadiene or isoprene; a vinyl halide such as vinyl chloride, vinyl bromide or vinyl fluoride; a vinyl ester such as vinyl acetate, vinyl propionate, or vinyl benzoate; an α-methylene aliphatic monocarboxylic acid ester such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, or diethylaminoethyl methacrylate; an acrylate ester such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, or phenyl acrylate; a vinyl ether such as vinyl methyl ether, vinyl ethyl ether or vinyl isobutyl ether; a vinyl ketone such as vinyl methyl ketone, vinyl hexyl ketone or methyl isopropenyl ketone; an N-vinyl compound such as N-vinylpyrrole, N-vinylcarbazole, N-vinylindole or N-vinylpyrrolidone; a vinylnaphthaline; and a derivative of acrylic acid or methacrylic acid such as acrylonitrile, methacrylonitrile or acrylamide.

The examples also include an α,β-unsaturated acid such as acrylic acid, methacrylic acid, crotonic acid or cinnamic acid; an α,β-unsaturated acid anhydride such as crotonic anhydride or cinnamic anhydride; an anhydride of such α,β-unsaturated acid and a lower aliphatic acid; and a monomer having a carboxyl group, such as alkenylmaronic acid, alkenylglutric acid, alkenyladipic acid or a monoester thereof.

The examples still further include an acrylate or methacrylate ester such as 2-hydroxyethyl acrylate, 2-hydroxyethyl methacrylate or 2-hydroxypropyl methacrylate; and a monomer having a hydroxyl group, such as 4-(1-hydroxy-1-methylbutyl)styrene, or 4-(1 hydroxy-1-methylhexyl)styrene.

Examples of the vinyl monomer yet further include an unsaturated dicarboxylic acid half ester such as maleic acid half methyl ester, maleic acid half ethyl ester, maleic acid half butyl ester, citraconic acid half methyl ester, citraconic acid half ethyl ester, citraconic acid half butyl ester, itaconic acid half methyl ester, alkenylsuccinic acid half methyl ester, fumaric acid half methyl ester, or mesaconic acid half methyl ester; an unsaturated dicarboxylic acid diester such as dimethyl maleate, or dimethyl fumarate; an unsaturated dicarboxylic acid such as maleic acid, citraconic acid, itaconic acid, alkenylsuccinic acid, fumaric acid, or mesaconic acid; and an unsaturated dicarboxylic anhydride such as maleic anhydride, citraconic anhydride, itaconic anhydride, or alkenylsuccinic anhydride.

In the case of calculating the proportion of the polyester component with respect to all the monomer components used for producing the binder resin of the invention, only the aforementioned component will be calculated as the polyester monomer component.

The polymer may be crosslinked, if necessary, with a crosslinking monomer shown in the following.

Examples of an aromatic divinyl compound include divinylbenzene, and divinylnaphthalene; those of a diacrylate compound bonded by an alkyl chain include ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and compounds obtained by replacing acrylate with methacrylate in the foregoing.

Examples of a diacrylate compound bonded by an alkyl chain containing an ether bond include diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by replacing acrylate with methacrylate in the foregoing.

Examples of a diacrylate compound linked by an alkyl chain containing an aromatic group and an ether bond include polyoxyethylene(2)-2,2-bis(4-hydroxydiphenyl)propane diacrylate, polyoxyethylene(4)-2,2-bis(4-hydroxyphenyl) propane diacrylate, and compounds obtained by replacing acrylate with methacrylate in the foregoing; and examples of a polyester-type diacrylate include MANDA (trade name, manufactured by Nippon Kayaku Co.).

Examples of a polyfunctional crosslinking agent include pentaerythritol triacrylate, trimethylolethane triacrylate, trimethylolpropanel triacrylate, tetramethylolmethane tetraacrylate, oligoester acrylate and compounds obtained by replacing acrylate with methacrylate in the foregoing; and triallyl cyanurate and triallyl trimellitate.

Such crosslinking agents are preferably used in an amount of 0.01-10.0 parts by weight (more preferably 0.03-5 parts by weight) with respect to 100 parts by weight of other vinyl monomer components.

A polymerization initiator to be used in the preparation of the vinyl polymer component may be 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl 2,2'-azobisisobutyrate, 1,1'-azobis(1-cyclohexanecarbonitrile), 2-(carbamoylazo)isobutyronitrile, 2,2'-azobis(2,4,4-trimethylpentane), 2-phenylazo-2,4-dimethyl-4-methoxyvaleronitrile, 2,2'-azobis(2-methylpropane); a ketone peroxide such as methyl ethyl ketone peroxide, acetylacetone peroxide, or cycylohexanone peroxide; 2,2-bis(t-butylperoxy)butane, t-butyl hydroperoxide, cumeme hydroperoxide, 1,1,3,3-tetramethylbutyl hydroperoxide, di-t-butyl peroxide, t-butylcumyl peroxide, dicumyl peroxide, α,α'-bis(t-butylperoxydiisopropyl)benzene, isobutyl peroxide, octanoyl peroxide, decanoyl peroxide, lauroyl peroxide, 3,5,5-trimethylhexanoyl peroxide, benzoyl peroxide, diisopropyl peroxycarbonate, di-2-ethylhexyl peroxydicarbonate, di-n-propyl peroxydicarbonate, di-2-ethoxyethyl peroxydicarbonate, dimethoxyisopropyl peroxydicarbonate, di(3-methyl-3-methoxybutyl) peroxycarbonate, acetylcyclohexyl sulfonyl peroxide, t-butyl peroxyacetate, t-butyl peroxyisobutyrate, t-butyl peroxyneodecanoate, t-butylperoxy-2-ethyl hexanoate, t-butyl peroxylaurate, t-butyl peroxybenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhesahydroterephthalate, and di-t-butyl peroxyazelate.

As the initiator to be used in producing the vinyl polymer component of the invention, The following polyfunctional polymerization initiator may be used singly or in combination with a monofunctional polymerization initiator.

Specific examples of the polyfunctional polymerization initiator having a polyfunctional structure include a polyfunctional polymerization initiator having two or more functional groups with a polymerization initiating function for example peroxide groups within a molecule, such as 1,1-di-t-butylperoxy-3,3,3-trimethylcyclohexane, 1,3-bis(t-butylperoxyisopropyl)benzene, 2,5-dimethyl-2,5(t-butylperoxy)hexane, 2,5-dimethyl-2,5(t-butylperoxy)hexane, tris(t-butylperoxy) triazine, 1,1-di-t-butylperoxycyclohexane, 2,2-di-t-butylperoxybutaone, 4,4-di-t-butylperoxyvaleric acid n-butyl ester, di-t-butyl peroxyhexahydroterephthalate, di-t-butyl peroxyazelate, di-t-butyll peroxytrimethyladipate, 2,2-bis(4,4-di-t-butylperoxycyclohexyl)propane or 2,2-t-butylperoxyoctane; and a polyfunctional polymerization initiator having a functional group with a polymerization initiating function for example a peroxide group and a polymerizable unsaturated group within a molecule such as diallylperoxy dicarbonate, tributylperoxymaleic acid, t-butylperoxyallyl carbonate or t-tubylperoxyisopropyl fumarate.

Among these, the following are more preferred: 1,1-di-t-butylperoxy-3,3,5-trimethylcyclohexane, 1,1-t-butylperoxycyclohexane, di-t-butyl peroxyhexahydroterephthalate, di-t-butyl peroxyazelate, 2,2-bis-(4,4-di-t-butylperoxycyclohexyl)propane and t-butylperoxyallyl carbonate.

The binder resin used in the invention is preferably selected from a hybrid resin having a polyester resin, a polyester component and a vinyl polymer component, a mixture of a hybrid resin and a vinylic resin, a mixture of a hybrid resin and a polyester resin, a mixture of a polyester resin, a hybrid resin and a vinyl polymer, and a mixture of a polyester resin and a vinyl polymer, and particularly preferably is a hybrid resin.

The hybrid resin, in which the polyester component and the vinyl polymer component are chemically bonded, tends to provide a uniform viscosity in the entire binder resin, in comparison with a simple blend of the polyester component and the vinyl polymer component. Therefore, even in the case where an ultra high polymer component such as a gel component is included, ultra fine powder is not easily generated at the crushing operation in the production of the magnetic toner, and the charging property of the magnetic toner can be improved.

In particular, the hybrid resin containing the polyester component polymerized utilizing the aromatic carboxylic acid titanium compound as the catalyst, showing a high mutual solubility of the vinyl polymer component and the polyester component, easily becomes uniform not only in the viscosity of the entire resin but also in the composition thereof, thus providing a very high environmental stability of the toner charging.

The hybrid resin is formed, for example, by ester exchange reaction of the polyester component and the vinyl polymer component obtained by a polymerization of a monomer component having a carboxylic acid ester group such as a (meth) acrylic acid ester, or by polymerizing a vinyl monomer in the presence of an unsaturated polyester component polymerized utilizing a monomer having an unsaturated group such as fumaric acid, whereby the vinyl polymer component is grafted to the unsaturated group of the polyester component.

The binder resin contained in the toner of the invention may be any resin having at least a polyester component, and the polyester component contained in the entire binder resin may account for preferably 30 wt. % or more of the entire binder resin in order to exhibit the effects of the invention, more preferably 40 wt. % or more and particularly preferably 50 wt. % or more.

The hybrid resin of the invention preferably contains, in the vinyl polymer component and/or the polyester component, a monomer component capable of reacting with both resin components. A monomer included in the polyester component and capable of reacting with the vinyl polymer component may be an unsaturated dicarboxylic acid such as phthalic acid, maleic acid, citraconic acid, or itaconic acid or anhydride thereof. Also a monomer included in the vinyl polymer component and capable of reacting with the polyester component may be a monomer having a carboxyl group or a hydroxyl group, an actylate ester or a methacrylate ester.

The reaction product of the vinyl polymer and the polyester resin is preferably obtained by a method of executing, in the presence of a polymer containing the aforementioned monomer component capable of reacting with each of the vinyl polymer component and the polyester component, polymerization reaction of either polymer or both polymers.

For producing the hybrid resin to be used in the invention, the following producing methods (1) to (6) may be employed:

(1) A method of blending the vinyl polymer and the polyester component after respective preparations, and the blend is produced by dissolution or swelling in an organic solvent (such as xylene) and distilling away the organic solvent. The hybrid resin component can be obtained by separately producing the vinyl polymer component and the polyester component, then dissolving or swelling them in a small amount of an organic solvent, adding an esterification catalyst and an alcohol, and heating the mixture to execute ester exchange reaction, thereby obtaining a synthesized hybrid resin having the polyester component and the vinyl polymer component.

(2) A method of generating and reacting, after preparing the vinyl polymer component, a polyester component in the presence of such a vinyl polymer component, thereby obtaining a hybrid resin component having the polyester component and the vinyl polymer component. The hybrid resin component can be obtained by reaction of a vinyl polymer component (also a vinyl monomer being added if necessary) with a polyester monomer (alcohol or carboxylic acid) and/or a polyester resin. An organic solvent can be suitably used also in this case.

(3) A method of generating and reacting, after preparing the polyester component, a vinyl polymer component in the presence of such polyester component, thereby obtaining a hybrid resin component having the polyester component and the vinyl polymer component. The hybrid resin component can be obtained by reaction of a polyester resin (a polyester monomer being added if necessary) with a vinyl monomer and/or a vinyl polymer.

(4) The hybrid resin component can be obtained, after preparing a vinyl polymer component and a polyester component, by adding a vinyl monomer and/or a polyester monomer (alcohol or carboxylic acid) in the presence of such polymer components. An organic solvent can be suitably used also in this case.

(5) After the preparation of a hybrid resin component having a polyester component and a vinyl polymer component, a vinyl monomer and/or a polyester monomer (alcohol, carboxylic acid) is added to execute an addition polymerization and/or a condensation polymerization reaction to obtain a vinyl polymer and/or a polyester resin, or further a hybrid resin component. In such case, the hybrid resin component having a polyester component and a vinyl polymer component may be a product in the aforementioned methods (2)-(4), or may be obtained by a known producing method if necessary. An organic solvent can be suitably used also in this case.

(6). A vinyl monomer and a polyester monomer (alcohol, carboxylic acid) are mixed and subjected to addition polymerization and condensation polymerization in succession to obtain a vinyl polymer component, a polyester component and a hybrid resin component having a polyester component and a vinyl polymer component. An organic solvent can be suitably used also in this case.

In the producing methods (1)-(6), the vinyl polymer component and/or the polyester component may be plural polymer components different in molecular weight and in crosslinking degree.

In the invention, the producing methods (2) and (3) are particularly preferably used.

In the invention, the vinyl polymer refers to a vinyl homopolymer or a vinyl copolymer.

The binder resin to be used in the present invention preferably has an acid value within a range of 1-100 mgKOH/g, and a hydroxyl value within a range of 1-100 mgKOH/g.

In the invention, an acid value of the binder resin can be measured in the following manner. A basic procedure is executed according to JIS K0070.

1) 0.5 to 2 g of crushed binder resin are precisely weighed to prepare a weight W (g) of the binder resin.

2) The sample is placed in a 300-ml beaker and dissolved by adding 150 ml of a toluene/ethanol mixture (weight ratio: 4/1).

3) Titration is executed with a potentiometric titration apparatus with a 0.1N KOH solution in methanol (automatic titration being possible, for example, with a potentiometric titration apparatus AT-400 (win workstation), manufactured by Kyoto Denshi Co., and an electrically operated burette ABP-410).

4) The consumption amount of the KOH solution in the above titration is represented by S (ml) and the consumption amount of the KOH solution in a blank test is represented by B (ml).

5) The acid value of the binder resin is calculated by the following equation wherein f is a factor of the KOH solution:

$$\text{acid value(mgKOH/g)}=((S-B)\times f\times 5.61)/W.$$

<Measuring Method for Hydroxyl Value of Binder Resin>

In the invention, a hydroxyl value of the binder resin can be measured in the following manner.

(A) Reagents (a) Acetylation reagent: 25 g of acetic anhydride is placed in a 100-ml measuring flask, then pyridine is added to the total volume of 100 ml, and the mixture is thoroughly blended by shaking. The acetylation reagent is stored in a brown bottle so as not to touch moisture, carbon dioxide gas or acid vapor.

(b) Phenolphthalein solution: 1 g of phenolphthalein is dissolved in 100 ml of ethyl alcohol (95 vol. %).

(c) N/2 potassium hydroxide-ethyl alcohol solution: 35 g of potassium hydroxide are dissolved in water as small volume as possible, then ethyl alcohol (95 vol. %) is added to a volume of 1 liter, and the solution is filtered after left standing for 2-3 days.

The binder resin to be used in the invention preferably has a glass transition temperature (Tg) of 50-75° C. A binder resin having a glass transition temperature lower than this range may result in insufficient storage stability of the toner, while a binder resin having a glass transition temperature exceeding this range may result in an insufficient fixing property of the toner.

The magnetic material to be used in the invention is preferably magnetic iron oxide containing a different element, such as magnetite, maghemite or ferrite, or a mixture thereof.

Among the above, preferred magnetic iron oxide contains at least an element selected from lithium, beryllium, boron, magnesium, aluminum, silicon, phosphor, germanium, titanium, zirconium, tin, lead, zinc, calcium, barium, scandium, vanadium, chromium, manganese, cobalt, copper, nickel, gallium, cadmium, indium, silver, palladium, gold, mercury, platinum, tungsten, molybdenum, niobium, osmium, strontium, yttrium, technetium, ruthenium, rhodium, and bismuth.

In the invention, the magnetic iron oxide preferably has, as magnetic properties in a magnetic field of 795.8 kA/m, a saturation magnetization of 10-200 $Am^2/kg$, more preferably 70-100 $Am^2/kg$, and a residual magnetization of 1-100 $Am^2/kg$, more preferably 2-20 $Am^2/kg$, and a coercive force of 1-30 kA/m, more preferably 2-15 kA/m.

In the invention, the magnetic iron oxide particles may be treated with a surface treating agent such as a silane coupling agent, a titanium coupling agent, a titanate, an aminosilane or an organic silicon compound.

The toner of the invention may also contain a colorant. The colorant usable in the invention may be any suitable dye or pigment. Examples of the pigment include carbon black, aniline black, acetylene black, naphthol yellow, Hanza yellow, rhodamine lake, alizarin lake, Indian red, phthalocyanine blue, and indanthrene blue. Such colorant is used in an amount necessary and sufficient for maintaining an optical density of a fixed image, specifically in an amount of 0.1-20 parts by weight, preferably 0.2-10 parts by weight, with respect to 100 parts by weight of the resin.

Also a dye may be used for the similar purpose. For example an azo dye, an anthraquinone dye, a xanthene dye or a methine dye may be used in an amount of 0.1-20 parts by weight, preferably 0.3-10 parts by weight with respect to 10.0 parts by weight of the resin.

In the invention, an aromatic hydroxycarboxylic acid metal compound represented by the following general formula is preferably used in order to accelerate charging and to improve the environmental stability of the developing property.

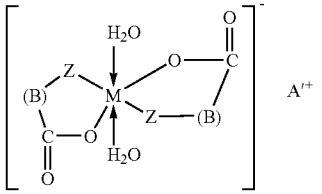

wherein M represents a center metal of coordination, which is Cr, Co, Ni, Mn, Fe, Ti, Zr, Zn, Si, B or Al; and (B) represents:

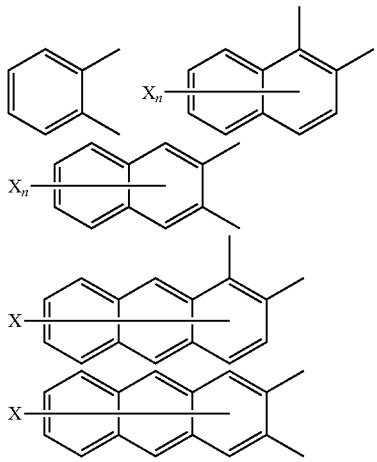

which may have a substituent such as an alkyl group; wherein X represents a hydrogen atom, a halogen atom, or a nitro group; n indicates an integer equal to or larger than 1; or

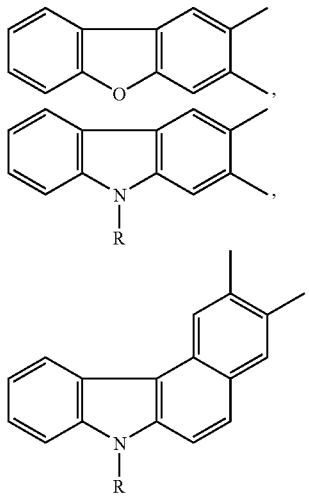

wherein R represents a hydrogen atom, an alkyl group with 1 to 18 carbon atoms or an alkenyl group with 2 to 18 carbon atoms; $A'^{+}$ represents a hydrogen, a sodium ion, a potassium ion, an ammonium ion or an aliphatic ammonium ion; and Z represents —O— or —C—O—.

In the following, specific examples of the hydroxycarboxylic acid metal compound are shown.

salicylic acid Al compound (1)

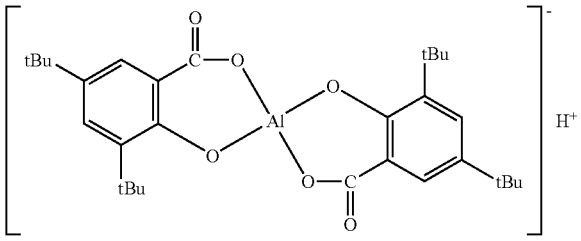

salicylic acid Zn compound (1)

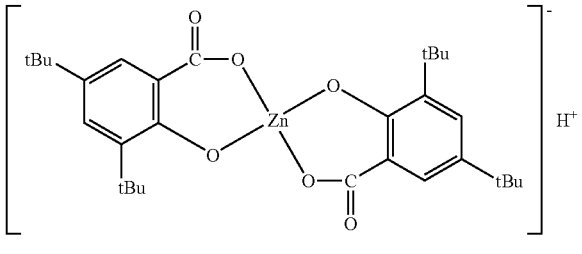

salicylic acid Cr compound (1)

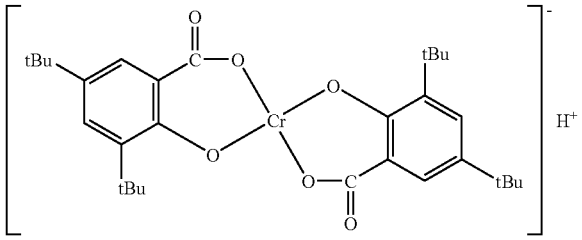

salicylic acid Zr compound (1)

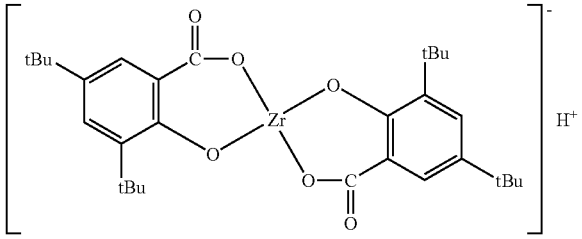

Among these, a compound having Al as the central metal is preferred for providing a larger charge amount. In these formulas, tBu is a tertiary butyl group.

In the toner of the invention, it is also preferable to include a monoazo iron compound as a charge controlling agent, in order to increase the charge of the toner and to improve the stability of the charge.

In particular, the monoazo iron compound represented by the following general formula is preferred for providing a high and stable charge amount.

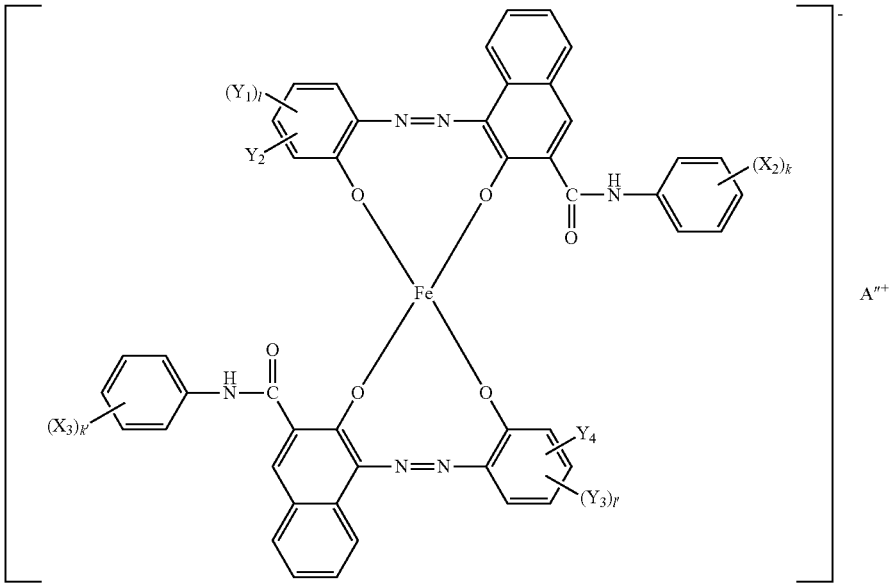

In the formula, $X_2$ and $X_3$ each represents a hydrogen atom, a lower alkyl group, a lower alkoxy group, a nitro group or a halogen atom; k and k' each represents an integer of 1-3; $Y_1$ and $Y_3$ each represents a hydrogen atom, an alkyl group with 1-18 carbon atoms, an alkenyl group with 2-18 carbon atoms, a sulfonamide group, a mesyl group, a sulfonic acid group, a carboxy ester group, a hydroxyl group, an alkoxy group with 1-18 carbon atoms, an acetylamino group, a benzoyl group, an amino group, or a halogen atom; l and l' each represents an integer of 1-3; $Y_2$ and $Y_4$ each represents a hydrogen atom or a nitro group; in which $X_2$ and $X_3$, k and k', $Y_1$ and $Y_3$, l and l', or $Y_2$ and $Y_4$ may be the same or different from each other.

$A''^{+}$ represents an ammonium ion, a sodium ion, a potassium ion, a hydrogen ion or mixed ions thereof, preferably containing ammonium ion by 75-98 mol. %.

In the following, specific examples of the monoazo iron compound are shown.

monoazo iron compound (1)

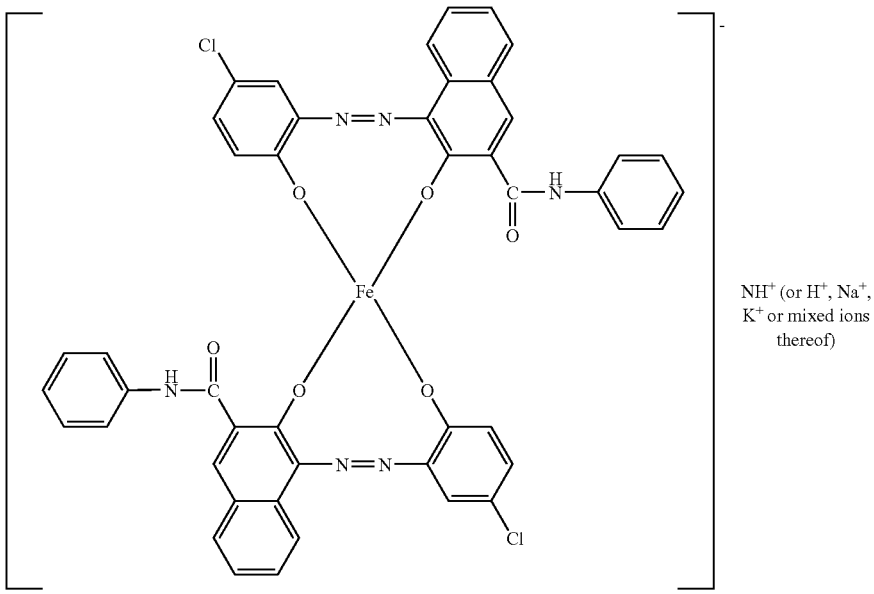

monoazo iron compound (2)
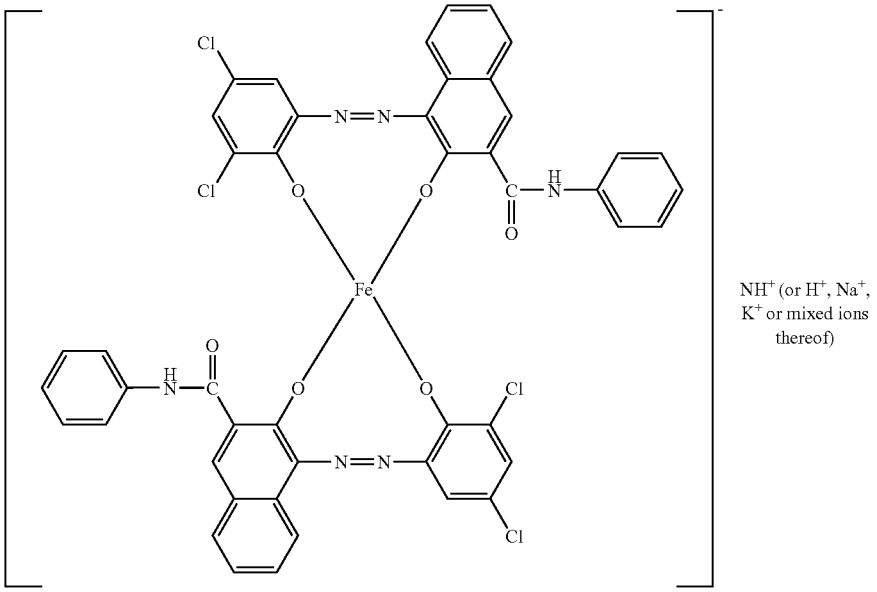
monoazo iron compound (3)
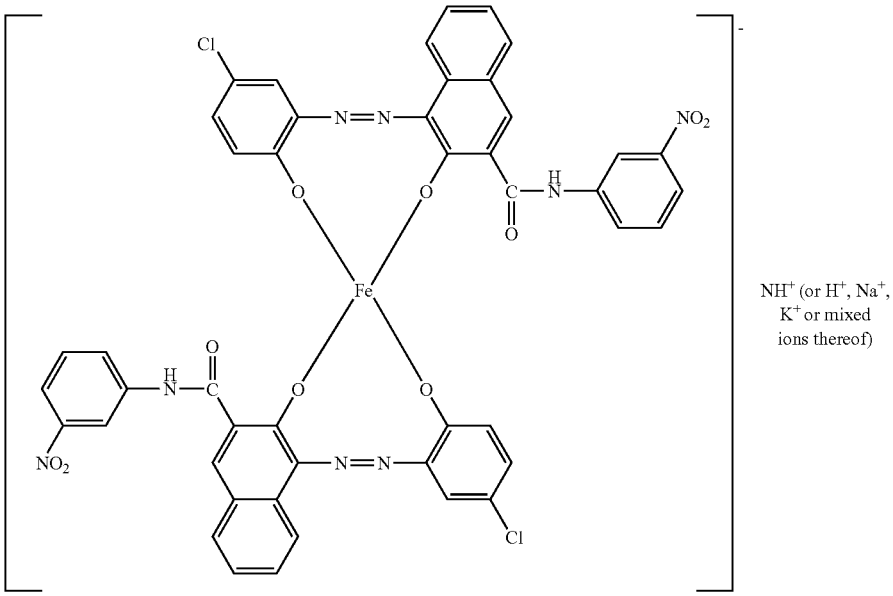

monoazo iron compound (4)
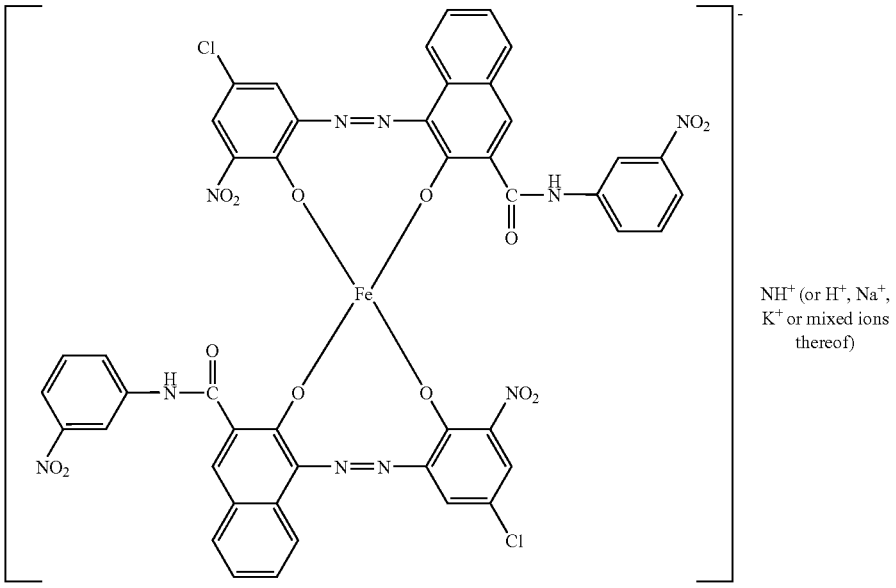
monoazo iron compound (5)
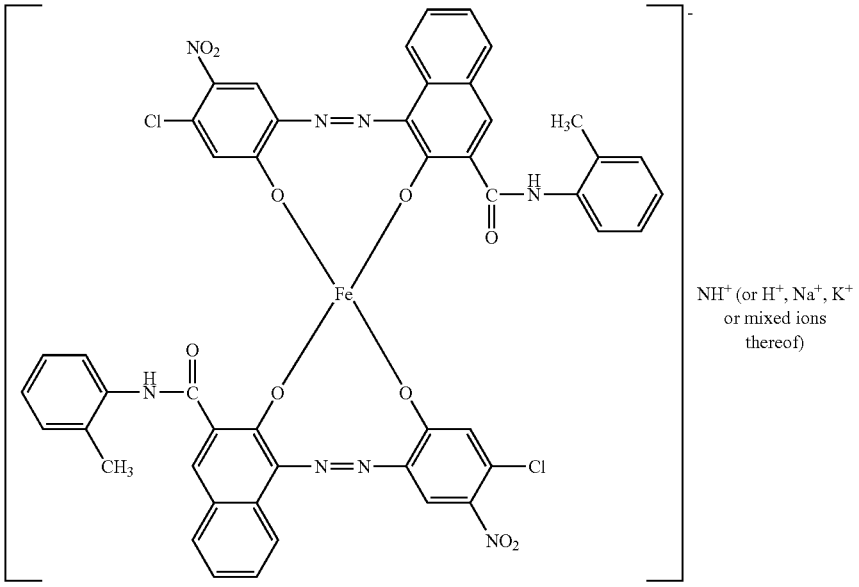

monoazo iron compound (6)

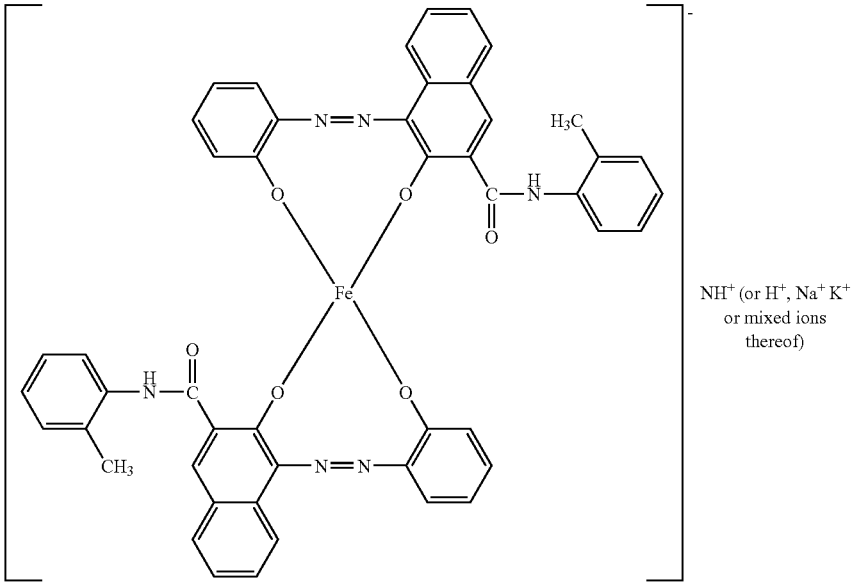

monoazo iron compound (7)

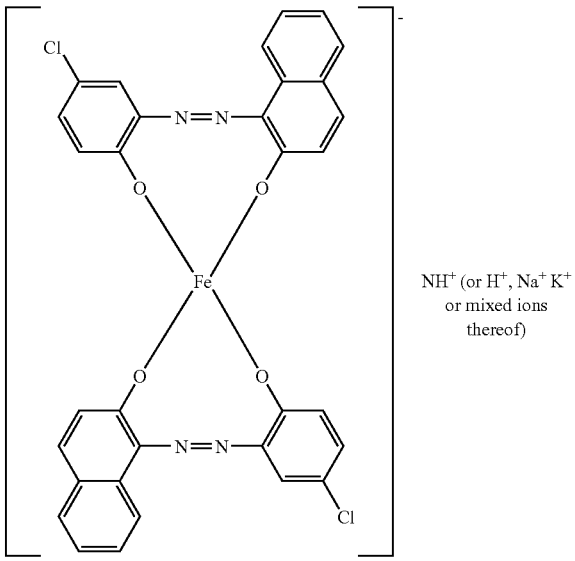

Among these, the compound represented by the formula of the monoazo iron compound (1) is preferred for providing a larger charge amount.

Such a monoazo iron compound is used in an amount within a range of 0.1-10 parts by weight, preferably 0.1-5 parts by weight, with respect to 100 parts by weight of the binder resin.

In the present invention, a combination of a hydroxycarboxylic acid Al compound and a monoazo iron compound is particularly preferred because it drastically increases the charge amount of the toner is drastically increased and the environmental stability of the developing property is improved when combined with the polyester component polymerized utilizing the aromatic carboxylic acid titanium compound.

The toner of the invention may contain a wax.

In the invention, various waxes may be used: for example, an aliphatic hydrycarbon wax such as low molecular polyethylene, low molecular polypropylene, a polyolefin copolymer, polyolefin wax, microcrystalline wax, paraffin wax, or Fischer-Tropsch wax; an oxidate of an aliphatic hydrycarbon wax such as oxidized polyethylene wax; a vegetable wax such as candelilla wax, carnauba wax, Japan tallow or jojoba wax; an animal wax such as bee wax, lanoline, or whale wax; a mineral wax such as ozokelite, ceresine or petrolactam; a wax principally constituted of an aliphatic ester such as montanate ester wax or castor wax; or a partially or completely deoxidized aliphatic wax such as deoxidized carnauba wax.

As the wax, the following may also be used: a saturated linear fatty acid such as palmitic acid, stearic acid, montanic acid or a long-chain alkyl carboxylic acid having a longer alkyl group; an unsaturated fatty acid such as brassidic acid, eleostearic acid, or valinaric acid; a saturated alcohol such as stearyl alcohol, eicosyl alcohol, behenyl alcohol, carnaubyl alcohol, seryl alcohol, melissyl alcohol or an alkyl alcohol having a longer alkyl group; a polyhydric alcohol such as sorbitol; an aliphatic amide such as linolic amide, oleic amide, or lauric amide; a saturated aliphatic bisamide such as methylenebisstearic amide, ethylenebiscapric amide, ethylenebislauric amide or hexamethylenebisstearic amide; an unsaturated aliphatic acid amide such as ethylenebisoleic amide, hexamethylenebisoleic amide, or N,N'-dioleylsebacic amide; an aromatic bisamide such as m-xylenebisstearic amide, or N,N'-distearylisophthalic amide; an aliphatic metal salt (generally called metal soap) such as calcium stearate, calcium laurate, zinc stearate or magnesium stearate; a wax formed by grafting a vinyl monomer such as styrene or acrylic acid to an aliphatic hydrocarbon wax; a partial ester of a fatty acid and a polyhydric alcohol such as behenyl monoglyceride; or a methyl ester compound having a hydroxyl group obtained by hydrogenation of a vegetable oil.

Also, the following waxes may be advantageously used: wax whose molecular weight distribution is concentrated in a narrow range or wax from which a low-molecular solid fatty acid, a low-molecular solid alcohol, a low-molecular solid compound and other impurities are eliminated by pressing, dissolution, recrystallization, vacuum evaporation, supercritical gas extraction or melt crystallization.

In the present invention, a particularly preferred wax is a hydrocarbon wax having a polar group such as an acid group, a hydroxyl group or an ester group. When combined with a binder resin containing a polyester component polymerized using an aromatic carboxylic acid titanium compound as the catalyst as used in the present invention, such wax provides the toner with a very high charge amount whose distribution is concentrated in a narrow range. It can therefore attain the improvement of the image quality, such as reducing sleeve ghosts and improving the reproducibility of small dots.

Such hydrocarbon wax having a polar group is particularly preferably used having an acid value of 1-50 mgKOH/g (preferably 1-30 mgKOH/g), a hydroxyl value of 5-100 mgKOH/g (preferably 20-80 mgKOH/g) and a melting point of 50-100° C.

The hydrocarbon wax having an acid group enhances the charging property of the wax and does not deteriorate the charging property of the toner even when the wax is exposed to the surface of the toner particles, whereby the charging property of the toner is improved. A hydrocarbon wax with an acid value less than 1 mgKOH/g may decrease the charging property of the wax, thereby deteriorating the developing property. In addition, a hydrocarbon wax with an acid value exceeding 100 mgKOH/g easily absorbs moisture, thereby deteriorating the developing property in a high humidity environment.

The hydrocarbon wax having an appropriate hydroxyl group in its molecule improves a dispersibility with the polyester component polymerized using the aromatic carboxylic acid titanium compound of the present invention as the catalyst. The reason therefore has not been clarified yet, but is supposed to be that the interaction between the hydrocarbon wax having a hydroxyl group and the titanium compound contained in the polyester component promotes dispersion of the wax as fine particles in the polyester component. A hydrocarbon wax having a hydroxyl value less than 5 mgKOH/g is not sufficiently finely dispersed, thereby deteriorating the developing property of the toner. A hydrocarbon wax having a hydroxyl value exceeding 100 mgKOH/g has an excessively high affinity with and the polyester component, thereby tending to form a mutual solution instead of fine dispersion to deteriorate the mechanical strength and the durability in continuous running.

The acid value and the hydroxyl value of the hydrocarbon wax can be measured by methods as explained later. The acid value and the hydroxyl value of the hydrocarbon wax can be regulated, for example, in a step of forming a borate ester of the hydrocarbon wax from an aliphatic hydrocarbon wax and hydrolyzing such borate ester of the hydrocarbon wax, by changing an addition amount or ratio of boric acid and boric anhydride added as catalysts, a reaction temperature and a reaction time, and in particular, a ratio of a hydroxyl value and an ester value can be regulated, in each of the esterification reaction and the hydrolysis reaction, by changing a reaction temperature and a reaction time to regulate an inversion rate.

The aforementioned hydrocarbon wax has a melting point of 50-100° C., preferably 60-80° C.

The melting point of the hydrocarbon wax less than 50° C. reduces the blocking resistance and offset resistance of the toner, thereby inducing stain on a developer carrying member, whereas a melting point exceeding 100° C. may detrimentally affect the fixing property of the toner.

The melting point of the hydrocarbon wax can be measured by a method to be explained later. Also the melting point of the hydrocarbon wax can be regulated, for example, by a type of the hydrocarbon wax or a modification such as an alcoholization.

The hydrocarbon wax having a polar group used in the invention preferably includes a hydrocarbon chain of the following structure.

More specifically, it at least has a molecular chain of a secondary alcohol structure having a hydroxyl group on a secondary carbon atom or a molecular chain of a primary alcohol structure having a hydroxyl group on a primary carbon atom as represented by partial structural formula (A) or (E). It also has a molecular chain having a carboxyl group on a primary or secondary carbon atom as represented by partial structural formula (C) or (D). The partial structure (A) or (E) and the partial structure (C) or (D) may be present within a single hydrocarbon chain. A molecular chain having an ester structure having an ester bond as represented by partial structural formula (B) may be present. More preferably, the hydrocarbon chain includes molecular chains having an alcohol structure, a carboxyl group and an ester bond represented respectively by the partial structures (A) or (E), (C) or (D) and (B).

Also, a single hydrocarbon chain may arbitrarily have structures of the partial structures A, B, C, D and E.

(A)

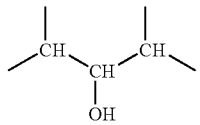

(B)

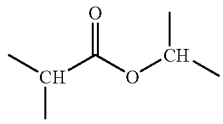

(C)

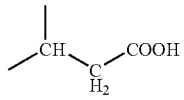

(D)

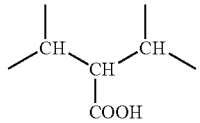

(E)

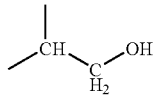

The hydrocarbon wax used in the invention is preferably an aliphatic hydrocarbon wax in consideration of influence on the dispersibility in the toner particles and the charging property of the toner, particularly preferably an aliphatic hydrocarbon wax having a hydroxyl group.

A series of steps of generating a hydrocarbon wax having a hydroxyl group from an aliphatic hydrocarbon wax is called alcoholization. The alcoholization can be executed by various processes, for example, by a method of generating a borate ester of the hydrocarbon wax from a hydrocarbon wax and hydrolyzing the borate ester of the hydrocarbon wax, thereby generating a hydrocarbon wax having a hydroxyl group. The hydrocarbon wax with the desired characteristics is preferably obtained by utilizing the alcoholization process, because the inversion rate of the acid group, hydroxyl group and ester group of the hydrocarbon wax can be easily controlled.

For producing a hydrocarbon wax having a hydroxyl group from an aliphatic hydrocarbon wax, a method may be used in which liquid-phase oxidation of the hydrocarbon wax is carried out using a molecular oxygen-containing gas in the presence of a boric acid and a boric anhydride. A mixture of boric acid and boric anhydride can be used as a catalyst. A mixing ratio of the boric acid and boric anhydride (boric acid/boric anhydride) is within a range of 1.0-2.0 in molar ratio, preferably 1.2-1.7. In the case where the proportion of boric anhydride is less than the aforementioned range, an excess of boric acid induces agglomeration. Also in the case where a proportion of boric anhydride exceeds the aforementioned range, a powder substance derived from boric anhydride is recovered after the reaction, and an excess of boric anhydride does not contribute to the reaction and is uneconomical.

An addition amount of boric acid and boric anhydride, in an amount of the mixture converted into the boric acid, is preferably 0.001-10 moles with respect to 1 mole of the aliphatic hydrocarbon used as the raw material, particularly preferably 0.1-1.0 mole.

The molecular oxygen-containing gas to be blown into the reaction system may be gases in a wide range, such as oxygen, air or gas diluted with an inert gas, but preferably has an oxygen concentration of 1-30 vol. %, more preferably 3-20 vol. %.

The liquid-phase oxidation reaction is usually executed in the melting state of the aliphatic hydrocarbon used as the raw material, without employing a solvent. The reaction temperature is 120-280° C., preferably 150-250° C., and the reaction time is 1-15 hours. Boric acid and boric anhydride are preferably mixed in advance and added to the reaction system. The addition of boric acid alone is undesirable because dehydration reaction of boric acid takes place. The mixed catalyst of boric acid and boric anhydride is added at a temperature of 100-180° C., preferably at 110160° C. The temperature lower than 100° C. is undesirable because the catalytic function of boric anhydride deteriorates, for example, by moisture remaining in the system.

After the reaction, water is added to the reaction mixture to hydrolyze the generated borate ester of wax, and purification is executed to produce a desired wax.

In the magnetic toner of the invention, hydrophobic inorganic fine particles are preferably added as an external additive to the magnetic toner particles.

The hydrophobic inorganic fine particles used in the invention may be an oxide such as wet process silica, dry process silica, titanium oxide, alumina, zinc oxide or tin oxide; a complex oxide such as strontium titanate, barium titanate, calcium titanate, strontium zirconate or calcium zirconate; or a carbonate such as magnesium carbonate, but may be preferably selected from silica, titanium oxide, alumina and complex oxides thereof in order to improve the developing property and the fluidity.

It is particularly preferred to use a fine powder formed by a vapor phase oxidation of a silicon halide compound, so-called dry process silica or fumed silica. For example, it is possible to utilize a pyrolytic oxidation reaction of silicon tetrachloride gas in an oxygen-hydrogen flame, based on the following reaction formula:

$$SiCl_4+2H_2+O_2 \rightarrow SiO_2+4HCl.$$

In this process, it is also possible to obtain a composite fine powder of silica and another metal oxide by using a halide of another metal such as aluminum chloride or titanium chloride together with the silicon halide compound, and the silica used in the present invention may include such products.

The hydrophobic inorganic fine particles used in the invention is preferably subjected to a hydrophobic treatment with one or more treating agents capable of reaction with or physical adsorption on the inorganic fine particles, such as a silicone varnish, a silicone oil, various modified silicon oils, a silane coupling agent, a silane coupling agent having a functional group, another organic silicon compound or an organic titanium compound.

Particularly, the treatment with a silane compound or a silicone oil is preferable, and with both is particularly preferable. The surface treatment with the treating agents of these two types enables the hydrophobicity distribution to be brought uniformly into a high hydrophobicity level, and uniform treatment to be effected thereby realizing an excellent fluidity, a uniform charging property and excellent moisture resistance, thus providing the toner with a satisfactory developing property, particularly a developing property and stability in continuous running under a high humidity condition.

The silane compound may be an alkoxysilane such as methoxysilane, ethoxysilane or propoxysilane; a halosilane such as chlorosilane, bromosilane or iodosilane; a silazane, a hydrosilane, an alkylsilane, an arylsilane, a vinylsilane, an acrylsilane, an epoxysilane, a silylsilane, a siloxane, a silylurea, a silylacetamide, or a silane compound containing different substituents in these silane compounds. Such silane compounds make it possible to achieve a fluidity, a transfer property and a stable charging property. Such silane compounds may be used alone or in combination.

Specific examples of the silane compound include hexamethylsilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptane, trimethylsilylmercaptane, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and having a hydroxyl group bonded to Si in each terminal unit. Such compounds may be used singly or in a combination of two or more kinds.

A silicone oil advantageously used in the invention may be a reactive silicone such as amino modified, epoxy modified, carboxyl modified, carbonol modified, methacryl modified, mercapto modified, phenol modified or another modified silicone; a non-reactive silicone such as polyether modified, methylstyryl modified, alkyl modified, fatty acid modified, alkoxy modified, or fluorine modified; or a straight silicone such as dimethyl silicone, methylphenyl silicone, diphenyl silicone, or methylhydrogen silicone.

Among such silicone oils, it is preferred to use a silicone oil having an alkyl group, an aryl group, an alkyl group in which all the hydrogen atoms or a part thereof is replaced with fluorine atoms, or a hydrogen atom as a substituent, such as dimethyl silicone oil, methylphenyl silicone oil, methylhydrogen silicone oil or fluorine-modified silicone oil.

Such silicone oils preferably have a viscosity at 25° C. of 5-2,000 $mm^2/s$, more preferably 10-1,000 $mm^2/s$ and further preferably 30-100 $mm^2/s$. A viscosity less than 5 $mm^2/s$ may not provide a sufficient hydrophobicity, and a viscosity exceeding 2,000 $mm^2/s$ may hinder uniform treatment of the inorganic fine particles and may form agglomerates, thereby resulting in an insufficient fluidity.

Such silicone oils may be used singly or in combination, or may be used for multi-treatment. Also, it may be used in combination with treatment with the silane compound.

The treatment of the inorganic fine particles with the silane compound may be executed by a known process, such as a dry process in which a gasified silane compound is reacted with the inorganic fine particles formed into a cloud state, for example, by agitation, or a wet process in which the inorganic fine particles are dispersed in a solvent and a silane compound is reacted by dropwise addition.

The treatment of the inorganic fine particles with the silane compound is executed by adding, to 100 parts by weight of the original inorganic fine particles, a treating agent of 5-40 parts by weight, preferably 5-35 parts by weight and more preferably 10-30 parts by weight.

The treatment with an oil is preferably executed by using the oil in an amount of 3-35 parts by weight with respect to 100 parts by weight of the inorganic fine particles, to provides an excellent developing property in a high temperature and high humidity environment.

In the present invention, it is particularly preferable to use hydrophobic silica which is subjected to a hydrophobic treatment with hexamethyldisilazane and then treated with a silicone oil. The treatment with hexamethyldisilazane can achieved uniform treatment and provides a toner with satisfactory fluidity, but the charging in a high temperature and high humidity environment cannot be stabilized only by such treatment. On the other hand, The treatment with a silicone oil can achieve a high charging amount in a high temperature and high humidity environment, but it is difficult to achieve uniform treatment, and, in order to achieve a uniform treatment, a larger amount of the silicone oil is required, tending to deteriorate the fluidity. The treatment with hexamethyldisilazane followed by a treatment with silicone oil enables uniform treatment with a smaller amount of oil, thereby achieving a high fluidity and a stable charging property in a high temperature and high humidity environment at the same time.

With the hydrophobic silica of the invention, hydrophobic treatment can be executed in the following manner.

A raw material silica is placed in a processing tank and agitated with agitating fins in the processing tank, and a predetermined amount of hexamethyldisilazane is mixed well by dropwise addition or spraying. In this operation, hexamethyldisilazane may be diluted with a solvent such as an alcohol. The raw material silica containing the mixed treating agent forms a powder cloud, which is then heated in a nitrogen atmosphere at a temperature equal to or higher than a boiling point of hexamethyldisilazane (preferably 150-250° C.) and refluxed under agitation for 0.5 to 5 hours. Thereafter, an excessive treatment agent may be eliminated if necessary.

The hydrophobic treatment of the raw material silica surface with a silicone oil may be executed by a known technology. For example, a raw material silica is placed in a processing tank and agitated with agitating fins in the processing tank, and silica particles are mixed with a silicone oil. Mixing with the silicone oil may be effected by a direct mixing with a mixing apparatus such as a Henshel mixer, or by spraying the silicone oil onto the raw material silica particles. It is also possible to dissolve or disperse the silicone oil in an appropriate solvent and mix it with the silica particles and then eliminating the solvent.

In the case of treatment with a silane compound and a silicone oil, it is advantageous to use a method of treating the raw material silica particles with a silane compound, then spraying a silicone oil and then heating the mixture at 200° C. or higher.

For the hydrophobic treatment of the hydrophobic silica of the invention, it is preferable to utilize batch treatment of charging a predetermined amount of raw material silica particles in a batch and executing the treatment in the batch under high-speed agitation, and the hydrophobic silica particles obtained in such batch treatment are uniformly treated and can constantly provide a stable quality.

An addition amount of the hydrophobic silica particles, which is variable depending on a type or a function thereof, is preferably 0.1-5 parts by weight (more preferably 0.1-3 mars by weight) with respect to 100 parts by weight of the toner particles.

In the magnetic toner of the invention, external additives other than the silica fine particles may be added if necessary. Such other additives include resinous fine particles or inorganic fine particles serving as a charging promoter, a conductivity providing agent, a fluidity providing agent, a caking preventing agent, a lubricant, an abrasive and the like.

Specific examples include a lubricant such as a fluorinated resin, zinc stearate or polyvinylidene fluoride among which polyvinylidene fluoride is preferable; an abrasive such as cerium oxide, silicon carbide or strontium titanate among which strontium titanate is preferable; a fluidity providing agent such as titanium oxide, or aluminum oxide among which a hydrophobic substance is preferable; a caking preventing agent; a conductivity providing agent such as carbon black, zinc oxide, antimony oxide or tin oxide; and developing promoter such as white fine particles and black fine particles of mutually opposite polarities, and such materials may be used in a small amount.

The magnetic toner of the present invention can be produced by an ordinary method for producing toner particles to be used for developing an electrostatic charge image. As the materials of the magnetic toner of the invention, at least the aforementioned binder resin and a magnetic iron oxide are used, and if necessary, other materials are used such as a colorant, a wax, a charge controlling agent and the like.

In the present invention, it is particularly preferable to use sphered magnetic toner particles. Sphered magnetic toner particles can be provided with a high charge amount and allow the charge amount distribution to be concentrated in a narrow range, thereby providing a high reproducibility of small dots on a photosensitive drum and improving the image quality. However, spherical magnetic toner formed in a prior technology deteriorates a coating stability of the magnetic toner on a developing sleeve, thereby aggravating fog and sleeve ghosts. In the magnetic toner of the invention containing the polyester component polymerized using the aromatic carboxylic acid titanium compound as the catalyst, the magnetic iron oxide is uniformly dispersed in the toner particles to provide a very low fluctuation of the magnetic properties among the toner particles and a uniform proportion of the magnetic iron oxide exposed to the toner particle surface, thereby achieving a very stable coating property of the toner on the developing sleeve.

For sphering the magnetic toner of the invention, the following may be used, for example, a method of sphering a toner obtained by a crushing method, such as a method of repeatedly giving toner particles a mechanical impact thereby forming spherical particles, or a method of dispersing toner particles in a dispersion medium such as a heated gas flow or a hot water thereby causing thermal sphering, or a spherical toner producing method such as a method of dissolving or dispersing toner materials in a solvent in which the binder resin is soluble, and eliminating the solvent by means of a spray drying apparatus to obtain spherical toner particles, or a method of dissolving or dispersing toner materials in a solvent in which the binder resin is soluble, then dispersing the obtained solution in a poor solvent for the binder resin (such as water or a water-methanol mixture) and eliminating the solvent to obtain spherical toner particles.

For obtaining the toner of the invention, it is particularly preferred to use a method of sufficiently mixing the aforementioned materials of the toner in a ball mill or a similar mixing apparatus, then kneading the mixture with a heat kneader such as a heated rolls, a kneader or an extruder, then, after solidification by cooling, executing a crude crushing, a fine crushing and a classification, and executing sphering by mechanical impact. Then, if necessary, desired additives are sufficiently mixed by means of a mixer such as a Henshell mixer to produce the toner of the invention.

The magnetic toner of the invention, containing the polyester component polymerized utilizing the aromatic carboxylic acid titanium compound as the catalyst, exhibits the high adhesion between the magnetic iron oxide and the binder resin, and the magnetic iron oxide exposed to the surfaces of the magnetic toner particles is not easily detached in the sphering of the magnetic toner by mechanical impact. Consequently, the magnetic iron oxide can always be present in a constant proportion on the surfaces of the magnetic toner particles, with almost no fluctuation among the toner particles, thereby providing the charge amount distribution of the magnetic toner concentrated in a narrow range, thus improving the reproducibility of small dots without aggravating the fog or the sleeve ghosts to achieve an improvement in the image quality.

In the magnetic toner of the present invention, the magnetic toner particles may be rendered spherical in such a manner that, in particles having a circle-equivalent diameter of 3 to 400 μm in measurement with a flow-type particle image measuring apparatus, an average circularity becomes equal to or higher than 0.935 but less than 0.995 (preferably equal to or higher than 0.935 but less than 0.970, more preferably equal to or higher than 0.935 but less than 0.965, further preferably equal to or higher than 0.935 but less than 0.960 and most preferably equal to or higher than 0.940 but less than 0.955). The average circularity less than 0.935 cannot sufficiently provide an effect for improving the image quality. The average circularity larger than 0.995 results in an excessive fluidity of the toner, thus retarding the triboelectric charging of the magnetic toner by friction with the developing sleeve or a developer regulating member, thereby causing fog or a low image density.

A toner particle producing method will be explained blow utilizing a mechanical impact for realizing a specified circularity distribution in the toner of the invention.

A sphering apparatus used in a sphering step and a toner particle producing method utilizing the sphering apparatus will be described specifically with reference to the accompanying drawings.

Figure 2:
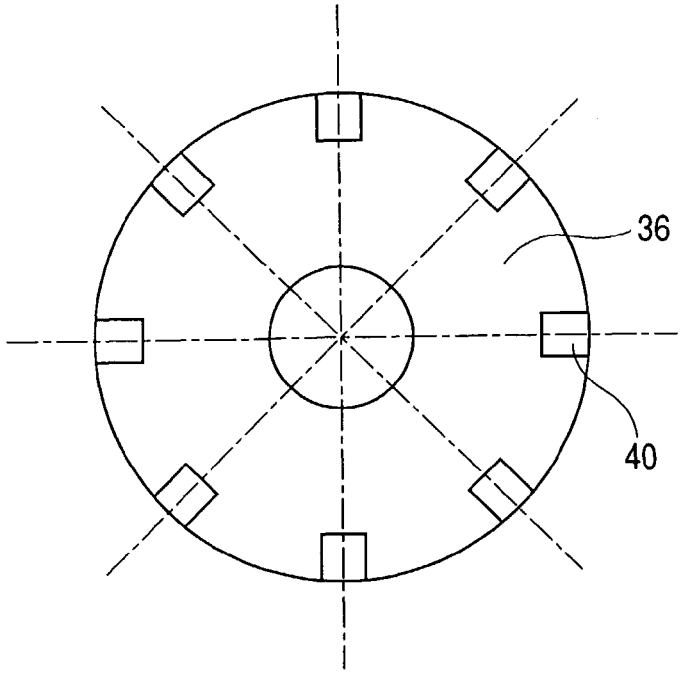
FIG. 2 is a schematic plan view of a dispersion rotor shown in FIG. 1.

FIG. 1 illustrates an example of the sphering apparatus used in the invention, and FIG. 2 is an example of a plan view of a rotor shown in FIG. 1, rotated at a high-speed.

The sphering apparatus shown in FIG. 1 is constituted of a casing; a jacket (not shown) capable of passing cooling water or a coolant liquid; a dispersing rotor 36 or a disc-shaped rotary member rotating at a high speed constituting sphering means, mounted on a rotary shaft at the center of the casing and provided with plural rectangular disks or cylindrical pins 40 on the upper surface; a liner 34 positioned at a predetermined gap from the external periphery of the dispersing rotor 36 and provided with plural surfacial grooves (such grooves being dispensable); a classification rotor 31 for classifying the sphered raw material into a predetermined particle size; a cold air inlet 35 for introducing a cold air; a raw material supply aperture 33 for introducing a raw material to be processed; a discharge valve 38 that can be opened or closed for regulating the sphering time; a powder outlet 37 for discharging the processed powder; and a cylindrical guide ring 39 serving as guide means for dividing a space between the classifying rotor 31 constituting the classifying means, and the dispersion rotor 36 and the liner 34 constituting the sphering means, into a first space 41 before entering the classifying means and a second space 42 for introducing the particles, after elimination of fine powder by the classifying means, into the sphering means. A gap between the dispersion rotor 36 and the liner 34 constitutes a sphering zone, and the classifying rotor 31 and the peripheral area thereof constitute a classifying zone.

The classifying rotor 31 may be positioned vertically as shown in FIG. 1, or horizontally. Also the classifying rotor 31 may be provided in one unit as shown in FIG. 1, or in plural units.

In the sphering apparatus of the aforementioned configuration, when the raw material toner particles are charged from the raw material supply aperture 33 in a state that the discharge valve 38 is closed, the charged raw material toner particles are at first sucked by a blower (not shown) and classified by the classifying rotor 31. The classified fine powder of a predetermined particle size or less is discharged continuously from the apparatus, and coarse particles larger than the predetermined particle size move along an internal periphery of the guide ring 39 (second space 42) by centrifugal force, and are guided to the sphering zone by circulating flow generated by the dispersion rotor 36. The raw material guided to the sphering zone undergoes mechanical impact between the dispersion rotor 36 and the liner 34, thus being sphered. The sphered particles is carried by cold air passing through the apparatus, and guided along the external periphery of the guide ring 39 (first space 41) to the classifying zone, where fine powder is discharged from the apparatus while coarse powder is returned to the sphering zone by a circulating flow and repeatedly sphered. After the lapse of a predetermined time, the discharge valve 38 is opened to recover the sphered particles.

In the invention, the toner particle sphering process is characterized in executing elimination of fine powder simultaneously with the toner particle sphering. It is thus possible to prevent the ultra fine particles present among the toner particles from adhering to the toner particle surfaces, thereby providing toner particles having a desired circularity and a desired amount of the ultra fine particles. In the case where it is impossible to carry out the fine powder elimination simultaneously with the sphering, the toner particles after sphering contain a larger amount of the ultra fine particles, and the ultra fine particles adhere to the surfaces of the toner particles having an appropriate particle size, due to mechanical and thermal effects in the sphering process. As a result, projections due to the adhering fine powder component are formed on the surface of the toner particles, and the toner particles having a desirable circularity cannot be obtained.

In the invention, "elimination of fine powder component simultaneous with sphering" means that the toner particle sphering and the fine powder elimination are executed in a repeated manner, and such process may be executed by conducting each of the processes as explained above in a single apparatus, or by conducting the sphering and the fine powder elimination respectively in different apparatuses and repeating each process.

As a result of investigation of the present inventors, a sphering time (cycle time, from the end of raw material charging to the opening of the discharge valve) in the sphering apparatus is 5 to 180 seconds, preferably 15 to 120 seconds. A sphering time less than 5 seconds may result in insufficient sphering of the toner particles because it is too short. On the other hand, a sphering time exceeding 180 seconds may result in melt adhesion in the apparatus by heat in the sphering or a lowering in a processing capacity, because it is too long.

Also in the toner particle producing method of the invention, the cold air flow introduced into the sphering apparatus preferably has a temperature T1 of 5° C. or lower. The air temperature T1 of the cold air introduced into the sphering apparatus is 5° C. or lower, more preferably 0° C. or lower and further preferably −5° C. or lower, which prevents melt adhesion in the apparatus by heat in the sphering. If the air temperature T1 of the cold air introduced into the sphering apparatus exceeds 5° C., it may induce melt adhesion in the apparatus by heat in the sphering.

The cold air flow introduced into the sphering apparatus is preferably subjected to moisture elimination in order to avoid dew condensation in the apparatus. A known apparatus may be utilized for such moisture elimination. A dew point of the supplied air is preferably −15° C. or lower, and more preferably −20° C. or lower.

In the toner particle producing method of the invention, it is preferable to equip the sphering apparatus with a jacket for cooling the interior of the apparatus and to execute the sphering by passing a coolant (preferably cooling water or more preferably an antifreeze liquid such as ethylene glycol) in the jacket. Such cooling by the jacket can prevent melt adhesion in the apparatus by the heat at the sphering.

The coolant passing through the jacket of the sphering apparatus preferably has a temperature of 5° C. or lower. The temperature of the coolant, passing through the jacket of the sphering apparatus, is 5° C. or lower, more preferably 0° C. or lower and further preferably −5° C. or lower, in order to prevent melt adhesion in the apparatus by heat in the sphering. A coolant temperature in the jacket, exceeding 5° C. may induce melt adhesion in the apparatus by heat in the sphering.

In the toner particle producing method of the invention, The temperature T2 behind the classifying rotor in the sphering apparatus is preferably maintained at 60° C. or lower. The temperature T2 behind the classifying rotor in the sphering apparatus is 60° C. or lower, preferably 50° C. or lower, in order to prevent melt adhesion in the apparatus by heat in the sphering. The temperature T2 behind the classifying rotor in the sphering apparatus exceeding 60° C. may induce melt adhesion in the apparatus by heat in the sphering, because a higher temperature may be applied in the sphering zone.

In the toner particle producing method of the invention, the minimum gap between the dispersion rotor and the liner in the sphering apparatus is preferably 0.5 to 15.0 mm, more preferably 1.0 to 10.0 mm. Also the dispersion rotor preferably has a peripheral speed of 75 to 200 m/sec, more preferably 85 to 180 m/sec. The minimum gap between rectangular disks or cylindrical pins provided on the upper face of the dispersion rotor and the lower end of the cylindrical guide in the sphering apparatus is preferably 2.0 to 50.0 mm, more preferably 5.0 to 45.0 mm.

In the invention, the crushing surfaces of the dispersion rotor and the liner in the sphering apparatus are preferably subjected to anti-abrasive treatment, for increasing the productivity of the toner particles. There is no specific limitation concerning a method for the anti-abrasive treatment. the dispersion rotor and the liner in the sphering apparatus also are not restricted to ones having some specific shapes.

In the toner particle producing method of the invention, it is preferable to execute the sphering and the ultra fine powder elimination by the sphering apparatus, after raw material toner particles, formed into fine particles of an approximately desired particle size, are subjected to elimination of fine powder and coarse powder to a certain extent by an air flow classifier. The toner particles can be better dispersed in the sphering apparatus by eliminating the fine powder in advance. The fine powder component in the toner particles, having a larger specific surface area and a larger charge amount in comparison with other larger toner particles, are not easily separated from other toner particles and may not be appropriately classified by the classifying rotor, but the elimination in advance of the fine powder component in the toner particles facilitates dispersion of the individual toner particles in the sphering apparatus, whereby the ultra fine powder component can be appropriately classified by the classifying rotor and the toner particles of a desired particle size distribution can be obtained. As for the toner after eliminating the fine powder by the air flow classifier, the cumulative number-averaged distribution of the toner particles smaller than 4 μm, in particle size distribution measured by a Coulter counter, is equal to or larger than 10% but smaller than 50%, preferably equal to or larger than 15% but smaller than 45%, and more preferably equal to or larger than 15% but smaller than 40%, in order to achieve efficient elimination of the ultra fine powder component by the sphering apparatus of the invention. The gas flow classifier used in the invention may be, for example, Erbo Jet manufactured by Nittetsu Kogyo Co.).

Further, in the invention, the circularity of the toner particles can be controlled in a more appropriate value by regulating revolutions of the dispersion rotor and the classifying rotor of the sphering apparatus.

An average circularity in the invention is used as a simple index for quantitatively representing the particle shape, and is defined as a value obtained by measuring particles of a circle-equivalent diameter of 0.60-400 μm under conditions of 23° C., 60% RH with a flow-type particle image analyzing apparatus FPIA-2100, manufactured by Sysmex Inc. to determine a circularity of the measured particle by the following equation, and dividing the total sum of the circularities of the particles of a circle-equivalent diameter of 3-400 μm by the total number of the particles:

$$\text{circularity } a = L_0/L$$

wherein $L_0$ represents a circumferential length of a circle having the same projected area as a particle image; and L represents a circumferential length of a projected image of a particle in image processing with a resolution of 512×512 (a pixel of 0.3×0.3 μm).

The circularity used in the present invention is an index indicating a degree of irregularity of the toner particle or the toner, where the value 1.00 shows that the toner particle or the toner has a completely spherical shape, and the value becomes smaller as the surface shape becomes more complex. The measuring apparatus "FPIA-2100" used in the present invention employs a calculation method in which a circularity of each particle is calculated, and according to the resulting circularities, particles are classified into 61 classes divided in the circularity range of 0.4-1.0, and using each center value of the division points and a frequency in each division point, the average circularity is calculated. An error between the average circularity obtained by such calculating method and the average circularity obtainable with the calculation formula employing the sum of the circularities of the particles is very small and practically negligible, and, in the present invention, a calculating method partially modifying the concept of the calculation formula employing the sum of the circularities of the particles may be adopted for reasons of data handling, such as a reduction in the calculation time and simplification of the calculating formula. Also, the measuring apparatus "FPIA-2100" used in the present invention, in comparison with "EPIA-1000" which has been used for calculating the shape of the toner particles or the toner, shows an increased precision in the shape measurement of the toner particles or the toner due to an improvement in the magnification of the particle image and an increase in the processing resolution of a fetched image (from 256×256 to 512×512), thereby achieving more exacting capture of fine particles. Therefore, when more exact measurement of the shape and particle size distribution are required as in the present invention, the apparatus FPIA-2100 capable of providing more exact information on the shape and the particle size distribution is more useful.

As for a specific measuring method, in 200-300 ml of impurity-free water placed in a container, 0.1-0.5 ml of a surfactant, preferably an alkylbenzenesulfonate salt, are added as a dispersant, and 0.1-0.5 g of a sample for measurement are added. A suspension containing the sample is dispersed for 2 minutes by an ultrasonic oscillator, and the circularity distribution of the particles is measured at a concentration of $2\text{-}10\times10^3$ particle/μl. The ultrasonic dispersion is executed for example with the following apparatus under dispersing conditions below:

UH-150 (manufactured by EMT Co.)

output: level 5 constant mode

The measurement is carried out in the following manner.

The sample dispersion is allowed to pass through a flow path (spreading along the flowing direction) of a flat flow cell (thickness about 200 μm). Flash light and a CCD camera are mounted on opposite sides across the flow cell, so as to form an optical path crossing the thickness the flow cell. While the sample dispersion flows, the flash light is applied at intervals of 1/30 seconds for obtaining images of the particles flowing in the flow cell, whereby each particle is photographed as a two-dimensional image having a certain area parallel to the flow cell. Based on the area of the two-dimensional image of each particle, a diameter of a circle having the same area is calculated as a circle-equivalent diameter. A circularity of each particle is calculated from the projected area of the two-dimensional image and the circumferential length of the projected image of each particle.

The magnetic toner of the invention has an average toner surface roughness equal to or larger than 10.0 nm but less than 26.0 nm, preferably equal to or larger than 12.0 nm but less than 24.0 nm. The average toner surface roughness of the magnetic toner indicates the surface state after the particles of the external additive are added to the magnetic toner particle, and can comprehensively represent the surface state of the magnetic toner particle before adding the external additive and the adhesion state of the particles of the external additive on the magnetic toner particle.

The precise control of the surface roughness of the magnetic toner after adding the external additive makes it possible to control the contact frequency of the magnetic toner with a toner charging member such as a developing sleeve or a developer regulating blade, thereby providing a magnetic toner which can be quickly charged (1.e., a quick start of charging) and has a high charging property. As a result, a magnetic toner can be obtained providing a high image density and an excellent dot reproducibility and free from sleeve ghosts regardless of environments in which the toner is used.

An average surface roughness of the magnetic toner less than 10.0 nm indicates the state that the particles of the external additive are embedded in the surface of the magnetic toner particle or the state that the attached particles of the external additive are excessively few, whereby the magnetic toner cannot attain a sufficient charging property or a sufficient fluidity, thus resulting in a reduced image density or aggravated fog. Also, an average surface roughness of the magnetic toner equal to or higher than 26.0 nm indicates the state that the magnetic toner particle before attaching the external additive has an excessive surface irregularity or the state that the surface of the magnetic toner particle is unevenly coated with the particles of the external additive, whereby the magnetic toner tends to show deterioration in the charging property, thus tending to aggravate the sleeve ghosts or the dot reproducibility.

The magnetic toner of the invention, in which the magnetic iron oxide is uniformly dispersed because of the use of the binder resin containing the polymer component polymerized utilizing the aromatic carboxylic acid titanium compound as the catalyst, is free from an interface that is easily crushed or a portion that is easily sphered by mechanical impact at a crushing step or a sphering step in the toner formation. It is therefore possible to control the circularity and the average surface roughness of the magnetic toner in the preferred ranges of the present invention.

On the other hand, in the case of employing a binder resin containing a polyester component polymerized with a catalyst other than the aromatic carboxylic acid titanium compound, because of high-viscosity portions and low-viscosity portions localized in the binder resin, it may not be possible to control the circularity and the average surface roughness of the magnetic toner in the preferred ranges of the present invention.

In the invention, the average surface roughness of the magnetic toner is measured with a scanning probe microscope. An example of the measurement is shown in the following:

probe station: SPI3800N (manufactured by Seiko Instruments Co.)

measuring unit: SPA400 measuring mode: DFM (resonance mode) image cantilever: SI-DF40P resolution: 256 in X-direction 128 in Y-direction.

In the invention, a measurement is executed in a square area of 1 μm on the surface of the magnetic toner. The measured area is a 1 μm square area taken at the center of a magnetic toner surface measured in the scanning probe microscope. The magnetic toner particle to be measured is selected randomly from among toner particles having a weight-averaged particle size (D4) measured by a Coulter counter method. The measured data are subjected to a secondary correction. The measurement is conducted on five or more different particles, and the obtained data are averaged to find the average surface roughness of the magnetic toner.

In the following, various terms will be explained.

Average surface roughness (Ra)

It is a center line average roughness Ra, defined in JIs B0601, expanded three-dimensionally so as to be applicable to a measuring plane, and is an average of an absolute deviation from a reference plane to a designated plane, as indicated by the following equation:

$$Ra = \frac{1}{S_0}\int_{YH}^{YT}\int_{XI}^{XR}|F(X, Y) - Z_0|\,dX\,dY$$

wherein:

F(X, Y): a plane indicated by all measured data $S_0$: an area when a designated plane is assumed as ideally flat $Z_0$: an average value of Z data in the designated plane.

The designated plane in the invention means a 1 μm square measured area.

The magnetic toner of the present invention can be manufactured by known apparatuses, and as a mixing apparatus the following may be used: for example, Henshel Mixer (manufactured by Mitsui Mining Co.), Super Mixer (manufactured by Kawata Co.), Revocone (manufactured by Okawara Seisakusho Co.), Nauter mixer, Turbulizer or Cyclomix (manufactured by Hosokawa Micron-Ltd.), Spiral Pin Mixer (manufactured by Taiheiyo Kiko Co.) or Redige Mixer (manufactured by Matsubo Co.).

As a kneading apparatus, the following may be used: KRC kneader (manufactured by Kurimoto Tekkosho Co.), Buss-co-kneader (manufactured by Buss Inc.), TEM extruder (manufactured by Toshiba Machinery Ltd.), TEX two-shaft kneader (manufactured by Nippon Steel Inc.), PCM kneader (manufacture by Ikegai Tekkosho Co.), three-roll mill, mixing roll mill or kneader (manufactured by Inoue Mfg. Co.), Kneadex (manufactured by Mitsui Mining Co.), MS pressurized kneader or Kneader-ruder (manufactured by Moriyama Seisakusho Co.), or Bambury Mixer (manufactured by Kobe Steel Co.).

As a crusher, the following may be used Counter Jet Mill, Micron Jet or Inomizer (manufactured by Hosokawa Micron Ltd.), IDS mill or PJM jet crusher (manufactured by Nippon Pneumatic Industries Ltd.), Cross Jet Mill (manufactured by Kurimoto Tekkosho Co.), Urmax (manufactured by Nisso Engineering Co.), SK Jet-o-Mill (manufactured by Seishin Kigyo Co.), Cryptron (manufactured by Kawasaki Heavy Industries Ltd.), Turbo Mill (manufactured by Turbo Kogyo Co.), or Super Rotor (manufactured by Nisshin Engineering Co.).

As a classifier, the following may be used: Crushiel, Micron classifier or Spedic classifier (manufactured by Seishin Kigyo Co.), Turbo classifier (manufactured by Nisshin Engineering Co.), Micron separator or Turboplex (manufactured by ATP Inc.), TSP Separator (manufactured by Hosokawa Micron Ltd.), Erbojet (manufactured by Nittetsu Mining Co.), Dispersion separator (manufactured by Nippon Pneumatic Industries Ltd.), or YM Microcut (manufactured by Yasukawa Trading Co.).

Also as a sieving apparatus for sieving coarse particles, the following may be used: Ultrasonic (manufactured by Koei Sangyo Co.), Resonasieve or Gyronshifter (manufactured by Tokuju Kosakusho Co.), Vibrasonic system (manufactured by Dalton Inc.), Sonicreen (manufactured by Shinto Kogyo Co.), Turbe Screener (manufactured by Turbo Kogyo Co.), Microshifter (manufactured by Makino Sangyo Co.), or a circular vibration sieve. Measuring methods for physical data in the present invention will be explained in the following.

(Magnetic Properties of Magnetic Toner and Magnetic Iron Oxide)

The magnetic properties can be measured with a vibration magnetometer VSM-3S-15 (manufactured by Toei Kogyo Co.) under an external magnetic field of 795.8 kA/m.

EXAMPLES

Examples of the present invention will be explained below, and the present invention is by no means limited to those examples.

Aromatic Carboxylic Acid Titanium Compound Production Example 1

119.6 parts by weight of terephthalic acid were dissolved in 100 parts by weight of pyridine, then 80.4 parts by weight of tetra-n-butoxy titanium were dropwise added and the resulting mixture was left standing for 2 hours at 40° C. under a nitrogen atmosphere to react tetra-n-butoxy titanium and terephthalic acid. Then, pyridine and butanol formed by the reaction were distilled away under a reduced pressure to produce an aromatic carboxylic acid titanium compound 1.

Aromatic Carboxylic Acid Titanium Compound Production Example 2

A process was executed in the same manner as in the aromatic carboxylic acid titanium compound production example 1 except that 19.6 parts by weight of terephthalic acid was changed to 36.1 parts by weight of trimellitic anhydride and 80.4 parts by weight of tetra-n-butoxy titanium was changed to 63.9 parts by weight, to produce an aromatic carboxylic acid titanium compound 2.

Aromatic Carboxylic Acid Titanium Compound Production Example 3

A process was executed in the same manner as in the Production Example 1 of the aromatic carboxylic acid titanium compound except that 19.6 parts by weight of terephthalic acid was changed to 41.5 parts by weight of benzoic acid and 80.4 parts by weight of tetra-n-butoxy titanium were changed to 58.5 parts by weight of tetramethoxy titanium, to produce an aromatic carboxylic acid titanium compound 3.

Binder Resin Production Example 1 bisphenol derivative represented by formula (A) (R: propylene group; x+y=2.2): 400 parts by weight terephthalic acid: 70 parts by weight isophthalic acid: 60 parts by weight trimellitic anhydride: 30 parts by weight To the foregoing substances, 2 parts by weight of the aromatic carboxylic acid titanium compound 1 and 1 part by weight of titanyl oxalate were added as catalysts.

To the resulting mixture of the polyester monomers and the polymerization catalysts, a mixture of the following vinyl monomers and polymerization initiator was dropwise added over 2 hours at 160° C. under a nitrogen atmosphere to execute a polymerization of the vinyl polymer component:

styrene: 44 parts by weight butyl acrylate: 16 parts by weight acrylic acid: 16 parts by weight dicumyl peroxide: 3 parts by weight.

Thereafter, the temperature was raised to 220° C. to execute condensation polymerization for 10 hours or longer to a desired viscosity, thereby obtaining a hybrid resin (binder resin 1) in which a polyester component was grafted to the vinylic polymer component. The binder resin contained the polyester component by about 88 wt. %, and had Tg=55° C., peak molecular weight Mp=6900, a softening point of 138° C. and THF-insoluble matter of 11 wt. %.

Binder Resin Production Example 2 bisphenol derivative represented by formula (A) (R: ethylene group; x+y=2): 200 parts by weight bisphenol derivative represented by formula (A) (R: ethylene group; x+y=3): 200 parts by weight terephthalic acid: 180 parts by weight To the above mixture, 4 parts by weight of the aromatic carboxylic acid titanium compound 1 was added as a catalyst, and condensation polymerization was conducted for 10 hours at 230° C. Then, 40 parts by weight of trimellitic anhydride and 2 parts by weight of potassium titanyl oxalate were added as additional catalysts to further execute condensation polymerization, thereby obtaining a polyester resin (binder resin 2). The binder resin contained the polyester component by 100 wt. %, and had Tg=60° C., peak molecular weight Mp=10600, a softening point of 144° C. and THF-insoluble matter of 17 wt. %.

Binder Resin Production Example 3

A process was conducted in the same manner as in the binder resin production example 2 except that the aromatic carboxylic acid titanium compound 1 was replaced by 3 parts by weight of the aromatic carboxylic acid titanium compound 2, and potassium titanyl oxalate was not added, thereby obtaining a polyester resin (binder resin 3). The binder resin contained the polyester component by 100 wt. %, and had Tg=59° C., peak molecular weight Mp=9200, a softening point of 124° C. and THF-insoluble matter of 4 wt. %.

Binder Resin Production Example 4

A process was conducted in the same manner as in the binder resin production example 2 except that the aromatic carboxylic acid titanium compound 1 was replaced by 3 parts by weight of the aromatic carboxylic acid titanium compound 3, and potassium titanyl oxalate was not added, thereby obtaining a polyester resin (binder resin 4). The binder resin contained the polyester component by 100 wt. %, and had Tg=56° C., peak molecular weight Mp=7100, a softening point of 118° C. and THF-insoluble matter of 12 wt. %.

Binder Resin Production Example 5 bisphenol derivative represented by formula (A) (R: propylene group; x+y=2.2): 400 parts by weight terephthalic acid: 100 parts by weight isophthalic acid: 80 parts by weight To the above mixture, 5 parts by weight of titanium terephthalate was added as a catalyst, and condensation polymerization was conducted for 10 hours at 230° C. Then, 60 parts by weight of trimellitic anhydride was added as an additional catalyst to further execute the condensation polymerization, thereby obtaining a polyester resin (binder resin 5). The binder resin contained the polyester component by 100 wt. %, and had Tg=55° C., peak molecular weight Mp=5400, a softening point of 129° C. and THF-insoluble matter of 29 wt. %.

Binder Resin Production Example 6 bisphenol derivative represented by formula (A) (R: propylene group; x+y=2): 400 parts by weight fumaric acid: 85 parts by weight trimellitic anhydride: 60 parts by weight To the above mixture, 5 parts by weight of titanium terephthalate was added as a catalyst, and condensation polymerization was conducted at 230° C., thereby obtaining a polyester resin (binder resin 6). The binder resin contained the polyester component by 100 wt. %, and had Tg=53° C., peak molecular weight Mp=4700, a softening point of 115° C. and THF-insoluble matter of 29 wt. %.

Comparative Binder Resin Production Example 1 bisphenol derivative represented by formula (A) (R: propylene group; x+y=2.2): 400 parts by weight fumaric acid: 95 parts by weight trimellitic anhydride: 30 parts by weight To the above mixture, 3 parts by weight of tetramethoxy titanium was added as a catalyst, and condensation polymerization was conducted at 230° C., thereby obtaining a polyester resin (binder resin 7).

The binder resin contained the polyester component by 100 wt. %, and had Tg=52° C., peak molecular weight Mp=5100, a softening point of 105° C. and THF-insoluble matter of 3 wt. %.

Comparative Binder Resin Production Example 2

A process was conducted in the same manner as in the comparative binder resin production example 1 except that 2 parts by weight of tetramethoxy titanium and 2 parts by weight of dibutyl tin oxide were added as catalyst, thereby obtaining a polyester resin (binder resin 8). The binder resin contained the polyester component by 100 wt. %, and had Tg=54° C., peak molecular weight Mp=4400, a softening point of 111° C. and THF-insoluble matter of 7 wt. %.

Synthesis Example of Wax 1,000 g of Fischer-Tropsch wax as a raw material was charged in a cylindrical glass reactor, and heated to 140° C. under blowing a small amount of nitrogen gas (3.5 liter/min). After adding 26.1 g (0.1 moles) of a mixed catalyst of boric acid/boric anhydride of 1.44 (molar ratio), and the resulting mixture was reacted for 2 hours at 180° C. under blowing air (20 liter/min) and nitrogen (15 liter/min). After completing the reaction, warm water (95° C.) of the same amount as the reaction mixture was added to hydrolyze the reaction mixture, and hydrocarbon wax separated as an upper layer after left standing was collected and washed with water to produce wax A. The wax A had a hydroxyl value of 67 mgKOH/g, an acid value of 6 mgKOH/g and a melting point of 75° C.

(Measuring Method for Softening Point of Resin)

The softening point is measured by a suspension flow tester according to JIS K7210. More detailed measuring method is as follows.

Using an elevated type flow tester (manufactured by Shimadzu Corp.), a sample of 1 $cm^3$ is heated at a temperature elevating speed of 6° C./min and is extruded from a nozzle 1 mm in diameter and 1 mm in length under a load of 1960 $N/m^2$ (20 $kg/cm^2$) applied by a plunger to obtain an S-shaped curve which indicates a relationship between a plunger descent amount (flow value) and a temperature and has a height h, and a temperature corresponding to h/2 (a temperature at which a half of the resin flows out) is defined as the softening point Tm of the resin.

(Glass Transition Temperature Tg of Resin)

Measurement is executed with a differential scanning calorimeter (DSC) Q-1000 manufactured by Texas Instruments Inc., according to ASTM D3418-82. 5-20 mg, preferably 10 mg, of a sample for measurement is precisely weighed, placed in an aluminum pan, and measured under the normal temperature and normal humidity, within a measuring temperature range of 30-200° C. at a temperature elevating rate of 10° C./min, using an empty aluminum pan as a reference. A endothermic peak is obtained in the course of temperature elevation, and the intersection of the middle line between base lines of a differential thermal before and after appearance of the endothermic peak and the differential thermal curve is taken as the glass transition temperature Tg.

(Measurement of Molecular Weight of Resin)

The molecular weight on a chromatogram by gel permeation chromatography is measured under the following conditions.

Columns are stabilized in a heat chamber of 40° C., and tetrahydrofuran (THF) as a solvent is made to flow at a flow rate of 1 ml per minute through the columns at the temperature. A sample is dissolved in THF, then filtered with a 0.2 μm filter and the resulting filtrate is utilized as a sample. A measurement is conducted by injecting 50-200 μl of a THF solution of the resin, regulated at a concentration of 0.05-0.6 wt. %. The molecular weight distribution of the sample was calculated from a relationship between the logarithmic value and count number of a calibration line, prepared with several mono-dispersion standard polystyrene samples. As the standard polystyrene samples for preparing the calibration line, samples were used having molecular weights, for example, of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ manufactured by Pressure Chemical Co. or Toyo Soda Ltd., and it is desirable to utilize at least about 10 standard polystyrene samples. An RI (refractive index) detector is used as a detector.

As for the column, in order to exactly measure a molecular weight range of $10^3$ to $2\times10^6$, it is preferable to combine plural commercial polystyrene gel columns, such as a combination of μ-styragel 500, $10^3$, $10^4$ and $10^5$ manufactured by Waters Inc. or a combination of Shodex Ka-801, 802, 803, 804, 805, 806 and 807 manufactured by Showa Denko Co.

(Measuring Method for Melting Point of Wax and Glass Transition Temperature of Binder Resin)

In the invention, the melting point of the wax and a glass transition temperature of the binder resin can be measured with a differential scanning calorimeter (DSC measuring instrument) Q-1000 (manufactured by Texas Instruments Japan Inc.) under the following conditions. The melting point of the wax and the glass transition temperature of the binder resin are given by a temperature at which the endothermic peak is detected in the temperature elevation II of the following temperature curve:

sample: 5-20 mg, preferably 10 mg measuring method: sample being placed in an aluminum pan, with an empty aluminum pan being used as a reference temperature curve:

temperature elevation I (20→180° C., temperature elevation rate: 10° C./min)

temperature drop I (180→10° C., temperature reduction rate: 10° C./min)

temperature elevation II (10→180° C., temperature elevation rate: 10° C./min)

(Measuring Method of Hydroxyl Value of Wax)

The hydroxyl value of the wax in the invention is measured in the following manner.

Instruments a measuring cylinder (100 ml)

a whole pipette (5 ml)

a flat-bottomed flask (200 ml)

a glycerin bath

Reagents an acetylating agent (25 g of acetic anhydride placed in a 100-ml flask, added with pyridine to a volume of 100 ml and thoroughly mixed by shaking)

a phenolphthalein solution a 0.5 kmol/$m^3$ potassium hydroxide solution in ethanol Measuring Method (a) 0.5-6.0 g of a hydrocarbon wax are precisely weighed in the flat-bottomed flask, and 5 ml of the acetylating agent are added by means of the whole pipette.

(b) A small funnel is placed on the mouth of the flask, which is heated by immersing the bottom thereof by about 1 cm in the glycerin bath of 95-100° C. In order to avoid a temperature elevation of the neck of the flask by heat from the glycerin bath, a carboard disc having a round hole is fitted on the base of the neck of the flask.

(c) After 1 hour, the flask is taken out from the glycerin bath and is left standing to cool. Then, 1 ml of water is added from the funnel to decompose acetic anhydride under shaking.

(d) The flask is then heated again in the glycerin bath for 10 minutes in order to complete the decomposition, and, after left standing to cool, the funnel and the flask wall are washed with 5 ml of ethanol (95%).

(e) Several drops of the phenolphthalein solution are added as an indicator, and titration is executed with the 0.5 kmol/$m^3$ potassium hydroxide solution in ethanol, and the point in time where the pale pink color of the indicator has lasted for about 30 seconds is regarded as the end point.

(f) A blank test is executed through the steps (a) to (e) without adding the hydrocarbon wax.

(g) Where the sample is difficult to dissolve, the dissolution is effected by adding a small amount of pyridine or by adding xylene or toluene.

Calculation

A hydroxyl value of the hydrocarbon wax is determined from the obtained results, according to the following equation:

$$A=[\{(B-C)\times28.05\times f\}/S]+D$$

wherein:

A: hydroxyl value of hydrocarbon wax (mgKOH/g)

B: amount of 0.5 kmol/$m^3$ potassium hydroxide solution in ethanol required in the blank test (ml)

C: amount of 0.5 kmol/$m^3$ potassium hydroxide solution in ethanol required in the titration (ml)

f: factor of 0.5 kmol/$m^3$ ethanol potassium hydroxide solution in ethanol

S: weight of hydrocarbon wax (g)

D: acid value of hydrocarbon wax (mgKOH/g)

28.05: ½ of formula weight 56.11 of potassium hydroxide (Measuring Method for Acid Value of Wax)

Instruments an Erlenmeyer flask (300 ml)

a burette (25 ml)

a water bath or a hot-plate

Reagents 0.1 kmol/$m^3$ hydrochloric acid a 0.1 kmol/$m^3$ potassium hydroxide solution in ethanol (25 ml of the 0.1 kmol/$m^3$ hydrochloric acid are taken with the whole pipette in the Erlenmeyer flask, added with the phenolphthalein solution and titrated with the 0.1 kmol/$m^3$ potassium hydroxide solution in ethanol, and the factor is determined from the amount required for neutralization.)

a solvent for phenolphthalein solution (a mixture of diethyl ether and ethanol (99.5%) in a volume ratio of 1:1 or 2:1. It is added with several drops of the phenolphthalein solution immediately before use, and neutralized with the 0.1 kmol/$m^3$ ethanol potassium hydroxide solution in ethanol.)

Measuring Method (a) 1-20 g of wax is precisely weighed in the Erlenmeyer flask.

(b) 100 ml of solvent and several drops of the phenolphthalein solution as an indicator are added, and the resulting mixture is shaken well on the water bath until the wax is completely dissolved.

(c) Titration is executed with the 0.1 kmol/$m^3$ potassium hydroxide solution in ethanol, and the point in time where the pale pink color of the indicator has lasted for about 30 seconds is regarded as the end point.

Calculation

An acid value of the wax is determined from the obtained results, according to the following equation:

$$A=5.611\times B\times f/S$$

wherein:

A: acid value of wax (mgKOH/g)

B: amount of 0.1 kmol/$m^3$ potassium hydroxide solution in ethanol required in the titration (ml)

f: factor of 0.1 kmol/$m^3$ potassium hydroxide solution in ethanol

S: weight of wax (g)

5.611: 1/10 of formula weight 56.11 of potassium hydroxide

Magnetic Iron Oxide Production Example 1

In an aqueous solution of ferrous sulfate, sodium silicate was added in such a manner that the content of Si element was 0.6 wt. % with respect to the iron element, then a solution of caustic soda was added to prepare an aqueous solution containing ferrous hydroxide. Then, air was blown in under pH set at 10 to execute oxidation reaction at 80 to 90° C. to prepare a slurry for generating seed crystals.

After the formation of the seed crystals was confirmed, an aqueous solution of ferrous sulfate was suitably added to the slurry, and the oxidation reaction was conducted by air blowing while adjusting the pH of the slurry to 10. In the course of the reaction, while monitoring the progress of the reaction by analyzing the concentration of unreacted ferrous hydroxide, the pH of the solution was adjusted stepwise to pH=9 at the initial stage of the oxidation reaction, pH=8 at the intermediate stage and pH=6 at the later stage to control Si distribution in the magnetic iron oxide, thereby completing the oxidation reaction.

Then, into the alkaline suspension of the generated magnetic iron oxide containing Si elements, a water-soluble aluminum salt was added in such an amount that aluminum elements constitute 0.10 wt. % of the generated particles, and the pH value was regulated within a range of 6-8 to precipitate aluminum hydroxide on the surface of the magnetic iron oxide. Then, the precipitate was filtered, washed with water, dried and disintegrated to produce magnetic iron oxide having aluminum elements on the surface thereof. The generated magnetic iron oxide particles were washed, filtered and dried by an ordinary method.

The primary particles of the obtained magnetic iron oxide, forming agglomerates, was subjected to compressive and shearing forces by means of a mix marler, whereby the agglomerates were disintegrated into the primary particles of the magnetic iron oxide and the surface of the particles was made smooth, thereby obtaining magnetic iron oxide 1 of properties as shown in Table 1.

Magnetic Iron Oxide Production Examples 2 and 3

In the magnetic iron oxide production example 1, conditions of reaction temperature and pH were changed to obtain magnetic iron oxides 2 and 3 of properties as shown in Table 1.

TABLE 1

| | shape | particle size (μm) | σs ($Am^2$/kg) at 795.8 kA/m | σr ($Am^2$/kg) at 795.8 kA/m |
|---|---|---|---|---|
| magnetic iron oxide 1 | spherical | 0.18 | 81.3 | 5.8 |
| magnetic iron oxide 2 | spherical | 0.23 | 78.1 | 3.4 |
| magnetic iron oxide 3 | octahedral | 0.12 | 84.6 | 15.9 |

Example 1 binder resin 1: 100 parts by weight magnetic iron oxide 1: 100 parts by weight monoazo iron compound (1) (couter ions being a mixture of $NH_4^+$ and $Na^+$ with a mixing ratio $NH_4^+/Na^+$−7/3):2 parts by weight salicylic acid Al compound (1):1 part by weight wax A: 6 parts by weight The above-mentioned components were pre-mixed in a Henshell mixer, then melt kneaded by means of a 2-shaft extruder heated to 130° C., and the kneaded substance was cooled and roughly crushed by means of a hammer mill to produce a roughly crushed product. The resulting roughly crushed product was finely crushed by means of a mechanical crusher Turbo Mill (manufactured by Turbo Kogyo Co., rotor and stator surfaces plated with a chromium alloy containing chromium carbide (plating thickness 150 μm, surface hardness HV 1050)) at an air inlet temperature of −15° C., at an air outlet temperature of 49° C. and at a coolant temperature of −5° C. for cooling the crushing rotor and the liner, and the resulting finely crushed substance was subjected to precise simultaneous elimination of fine powder and coarse powder by means of a multi-division classifier utilizing the Coanda effect (Erbojet classifier manufactured by Nittetsu Mining Co.), thereby obtaining magnetic toner particles. The magnetic toner particles had a weight-averaged particle size (D4) of 6.1 μm and a cumulative number percentage of particles smaller than 4 μm in the number distribution of 26.3%.

The magnetic toner particles were subjected to sphering and fine powder elimination by means of the sphering apparatus shown in FIG. 1. In the present example, 16 rectangular disks were placed on the dispersing rotor, with a 60 mm gap between the guide ring and the rectangular disks on the dispersion rotor and a 4 mm gap between the dispersion rotor and the liner. The following conditions were employed: a peripheral speed of the dispersion rotor of 160 m/sec, an air amount of the blower of 30 $m^3$/min, a charge amount of the magnetic toner particles of 200 kg/hr, a cycle time of 60 sec, a coolant temperature of −15° C. through the jacket, and a cold air temperature T1 of −20° C. The peripheral speed of the classifying rotor was controlled to be 85 m/sec to provide a desired proportion of particles equal to or larger than 0.6 μm but smaller than 3 μm. Through these steps, negatively chargeable magnetic toner particles 1 were obtained having a weight-averaged particle size (D4) of 6.3 μm as measured by the Coulter counter method, and a cumulative number percentage of particles smaller than 4 μm in number distribution of 20.7%.

100 parts by weight of the magnetic toner particles and 1.2 parts by weight of hydrophobic silica fine particles formed by treating dry process silica (BET: 200 $m^2/g$) with hexamethyldisilazane and then with dimethylsilicone oil, were mixed in a Henshel mixer to produce magnetic toner 1.

The magnetic toner 1 had a saturation magnetization σs of 39.0 $Am^2/kg$, a residual magnetization σr of 2.8 $Am^2/kg$, an average circularity of 0.952 in particles having a circle-equivalent diameter of 3 to 400 μm in measurement with FPIA-2100, and an average surface roughness of 16.3 nm as measured with a scanning probe microscope.

Example 2

Magnetic toner 2 was prepared in the same manner as in Example 1 except that the binder resin 1 was changed to binder resin 2. Properties of the magnetic toner 2 are shown in Table 2.

Example 3

Magnetic toner 3 was prepared in the same manner as in Example 1 except that the binder resin 1 was changed to binder resin 3, the wax A was changed to 4 parts by weight of Fischer-Tropsch wax (DSC peak top temperature=104° C., Mx/Mn=1.8), and 1.2 parts by weight of the hydrophobic silica fine particles was changed to 1.5 parts by weight. Properties of the magnetic toner 3 are shown in Table 2.

Example 4

Magnetic toner 4 was prepared in the same manner as in Example 1 except that the raw material composition was changed as follows, and 1.2 parts by weight of the hydrophobic silica fine particles were changed to 1.0 part by weight. Properties of the magnetic toner 4 are shown in Table 2.

binder resin 4: 100 parts by weight magnetic iron oxide 2: 150 parts by weight monoazo iron compound (1) (counter ions being a mixture of $NH_4^+$ and $Na^+$ with a mixing ratio $NH_4^+/Na^+=7/3$): 2 parts by weight Fischer-Tropsch wax (DSC peak top temperature=104° C., Mx/Mn=1.8): 4 parts by weight Example 5

Magnetic toner 5 was prepared in the same manner as in Example 1 except that the raw material composition was changed as follows, and 1.2 parts by weight of the hydrophobic silica fine particles were changed to 0.8 part by weight. Properties of the magnetic toner 5 are shown in Table 2.

binder resin 5: 100 parts by weight magnetic iron oxide 3: 50 parts by weight monoazo iron compound (1) (counter ions being a mixture of $NH_4^+$ and $Na^+$ with a mixing ratio $NH_4^+/Na^+=7/3$): 2 parts by weight Fischer-Tropsch wax (DSC peak top temperature=104° C., Mx/Mn=1.8): 4 parts by weight Example 6

Magnetic toner 6 was prepared in the same manner as in Example 5 except that the binder resin 5 was changed to binder resin 6, and 0.8 parts by weight of the hydrophobic silica fine particles were changed to 0.6 part by weight. Properties of the magnetic toner 6 are shown in Table 2.

Example 7

The magnetic toner particles of Example 6 after the sphering and before the mixing of the hydrophobic silica were mixed with 1.0 part by weight of the same hydrophobic silica fine powder as in Example 1 and 1.0 part by weight of large-size hydrophobic silica fine powder, formed by treating dry process silica (BET: 50 $m^2/g$) with hexamethyldisilazane, by means of a Henshel mixer to produce magnetic toner 7. Properties of the magnetic toner 7 are shown in Table 2.

Example 8 binder resin 6: 100 parts by weight magnetic iron oxide 3: 200 parts by weight salicylic acid Zr compound (1): 2 parts by weight Fischer-Tropsch wax (DSC peak top temperature=104° C., Mx/Mn=1.8): 4 parts by weight The above-mentioned components were pre-mixed in a Henshel mixer, then melt kneaded by means of a 2-shaft extruder heated to 130° C., and the kneaded product was cooled and roughly crushed by means of a hammer mill to produce a roughly crushed product. The resulting roughly crushed product was finely crushed by means of a mechanical crusher Turbo Mill (manufactured by Turbo Kogyo Co., rotor and stator surfaces plated with a chromium alloy containing chromium carbide (plating thickness 150 μm, surface hardness HV 1050)) at an air inlet temperature of −10° C., at an air outlet temperature of 40° C. and at a coolant temperature of 0° C. for cooling the crushing rotor and the liner, and the resulting finely crushed product was subjected to precise simultaneous elimination of fine powder and coarse powder by a multi-division classifier utilizing the Coanda effect (Erbojet classifier manufactured by Nittetsu Mining Co.), thereby obtaining magnetic toner particles. The magnetic toner particles had a weight-averaged particle size (D4) of 6.7 μm and a cumulative number percentage of particles smaller than 4 μm in number distribution of 19.1%.

The magnetic toner particles were not subjected to sphering, and 100 parts by weight of the magnetic toner particles and 1.2 parts by weight of hydrophobic silica fine particles, formed by treating dry process silica (BET: 200 $m^2/g$) with hexamethyldisilazane and then with dimethylsilicone oil, were mixed by means of a Henshel mixer to produce magnetic toner 8. Properties of the magnetic toner 8 are shown in Table 2.

Example 9

Magnetic toner 9 was prepared in the same manner as in Example 8 except that 200 parts by weight of the magnetic iron oxide 3 was changed to 20 parts by weight of the magnetic iron oxide 2. Properties of the magnetic toner 9 are shown in Table 2.

Comparative Example 1 binder resin 7: 100 parts by weight magnetic iron oxide 3: 200 parts by weight salicylic acid Cr compound (1): 1 part by weight Fischer-Tropsch wax (DSC peak top temperature=104° C., Mx/Mn=1.8): 4 parts by weight The above-mentioned components were pre-mixed by means of a Henshel mixer, then melt kneaded by means of a 2-shaft extruder heated to 130° C., and the kneaded product was cooled and roughly crushed by means of a hammer mill to produce a roughly crushed product. The resulting roughly crushed product was finely crushed by means of a jet mill, and the resulting finely crushed product was subjected to a precise simultaneous elimination of fine powder and coarse powder by means of a multi-division classifier utilizing the Coanda effect (Erbojet classifier manufactured by Nittetsu Mining Co.), thereby obtaining magnetic toner particles. The magnetic toner particles had a weight-averaged particle size (D4) of 8.4 μm and a cumulative number percentage of particles smaller than 4 μm in number distribution of 11.9%.

100 parts by weight of the magnetic toner particles and 0.8 parts by weight of hydrophobic silica fine particles, formed by treating dry process silica (BET: 200 $m^2/g$) with hexamethyldisilazane and then with dimethylsilicone oil, were mixed by means of a Henshel mixer to produce magnetic toner 10. Properties of the magnetic toner 8 are shown in Table 2.

Comparative Example 2

Magnetic toner 11 was prepared in the same manner as in Comparative Example 1 except that the binder resin 7 was changed to binder resin 8. Properties of the magnetic toner 11 are shown in Table 2.

TABLE 2

| | Toner | σs ($Am^2/kg$) | σr ($Am^2/kg$) | average circularity | ave. surface roughness (nm) |
|---|---|---|---|---|---|
| Example 1 | mag. toner 1 | 39.0 | 2.8 | 0.952 | 16.3 |
| Example 2 | mag. toner 2 | 39.0 | 2.8 | 0.949 | 14.7 |
| Example 3 | mag. toner 3 | 39.0 | 2.8 | 0.943 | 24.9 |
| Example 4 | mag. toner 4 | 45.6 | 2.0 | 0.937 | 25.2 |
| Example 5 | mag. toner 5 | 26.9 | 5.1 | 0.964 | 11.0 |
| Example 6 | mag. toner 6 | 26.9 | 5.1 | 0.968 | 10.4 |
| Example 7 | mag. toner 7 | 26.8 | 5.0 | 0.968 | 27.5 |
| Example 8 | mag. toner 8 | 55.1 | 10.3 | 0.932 | 33.6 |
| Example 9 | mag. toner 9 | 12.2 | 0.5 | 0.929 | 34.5 |
| Comp. Ex. 1 | mag. toner 10 | 55.3 | 10.3 | 0.921 | 38.3 |
| Comp. Ex. 2 | mag. toner 11 | 55.2 | 10.2 | 0.915 | 40.1 |

Then, these prepared magnetic toners were evaluated in the following manner. Results of evaluation are shown in Table 3.

(Fixing Test)

A fixing device, taken out from a Hewlett Packard laser beam printer LaserJet 4300 and modified so that fixing temperature was able to be freely set and a process speed was 300 mm/sec, was used as an external fixing device.

Using such an external fixing device, temperature was adjusted every 5° C. within a temperature range of 150-200° C., fixing was carried out for solid black unfixed images (toner amount set at 0.6 $mg/cm^2$) formed on plain paper (90 $g/m^2$), then the images thus obtained were rubbed with silbon paper in 5 reciprocating cycles under a load of 4.9 kPa, and a temperature at which a density decrease due to the rubbing came to be 10% or less, was regarded as the fixing temperature. The lower the fixing temperature, the better the low-temperature fixing property of the toner is.

As for the high-temperature offset resistance, a process speed was set to be 100 mm/sec and temperature was adjusted every 5° C. within a temperature range of 180-240° C., fixing was carried out for solid black unfixed images (toner amount set at 0.6 $mg/cm^2$) formed on plain paper (75 $g/m^2$), then stains on the image due to an offset phenomenon was visually inspected, and a temperature at which offset occurred was regarded as the level of high-temperature offset resistance. The higher the temperature, the better the better the high-temperature offset resistance of the toner is.

(Developing Property Test)

A Hewlett Packard laser beam printer LaserJet 4300 modified to 55 ppm (with A4 size in the longitudinal direction, corresponding to a process speed of about 325 mm/sec), was used for the following evaluations.

(1) Image Density and Fog

In a normal-temperature and normal-humidity environment (23° C., 60% RH), a low-temperature and low-humidity environment (15° C., 10% RH) and a high-temperature and high-humidity environment (32.5° C., 80% RH), a lateral line pattern of a print ratio of 2% was printed on 10,000 sheets utilizing copying plain paper (75 $g/m^2$), in a mode in which the apparatus stopped once for each 1-sheet job.

Image density was measured, with Macbeth reflective densitometer (manufactured by Macbeth Inc.), as a relative density to a printout image corresponding to a white background of an original density of 0.00.

Fog in a low-temperature and low-humidity environment was calculated from a comparison between a whiteness of the transfer paper and a whiteness after printing a solid white image, measured by a Reflectometer (manufactured by Tokyo Denshoku Co.).

(2) Sleeve Ghost

Figure 3:
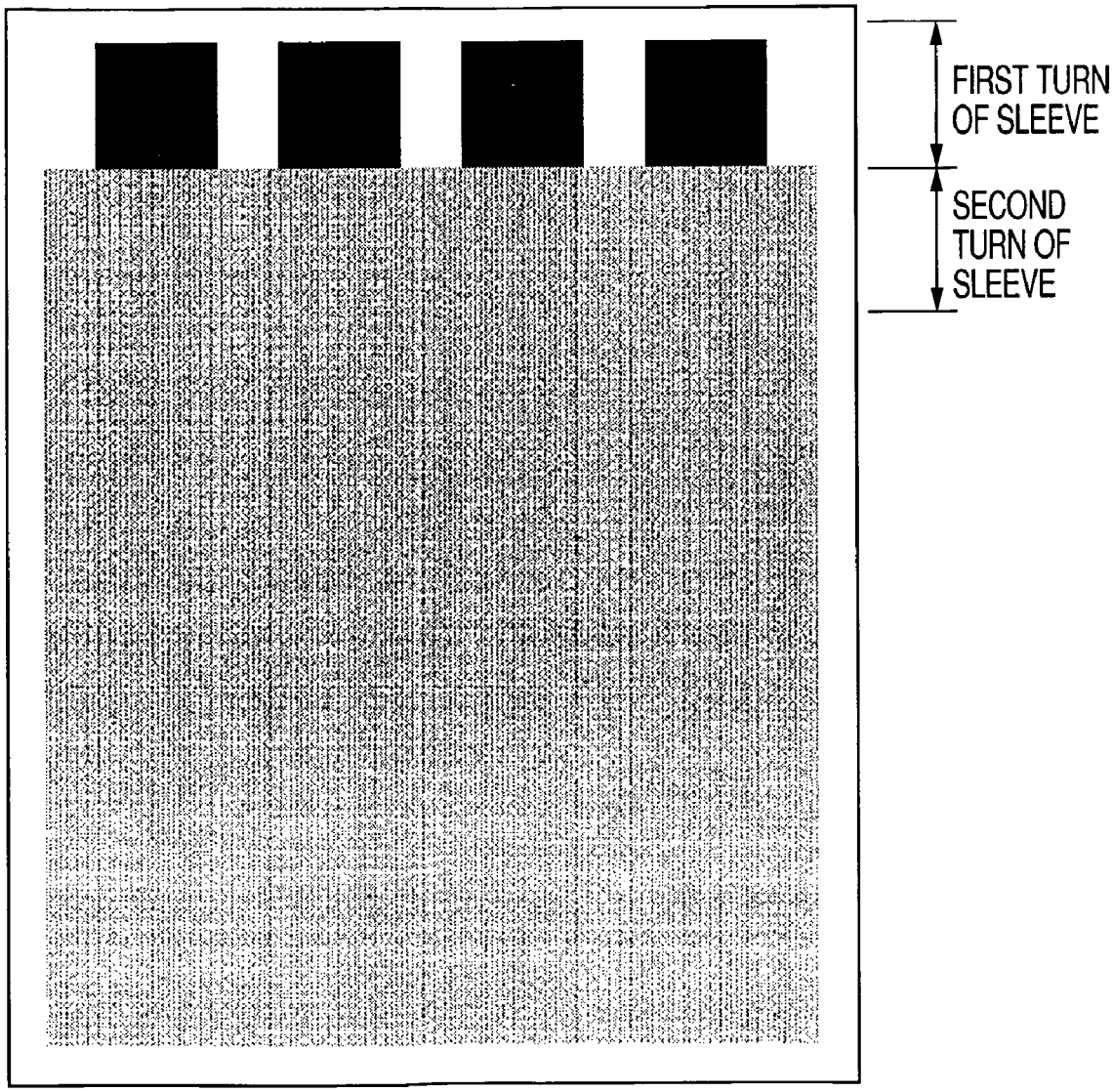
FIG. 3 is a view showing a pattern for evaluating a sleeve ghost.

In the course of the evaluation (1), sleeve ghosts were evaluated every 1,000 printouts. An image having a block-shaped solid black image for a length corresponding to a turn of the developing sleeve and a solid halftone image thereafter, as shown in FIG. 3, was printed, and the image was visually evaluated on the hysteresis level of the image in the first turn of the developing sleeve, appearing on the halftone image formed in the second and subsequent turns of the developing sleeve, according to the following criteria.

A negative ghost is a phenomenon in which, in an image formed in the second and subsequent turns of the developing sleeve, a portion corresponding to a black image portion in the first turn of the sleeve shows a lower image density than that of a portion corresponding to a non-image portion in the first turn, and a positive ghost is a phenomenon in which a portion corresponding to a black image portion in the first turn of the sleeve shows a higher image density than a portion corresponding to a non-image portion in the first turn. The ghost was evaluated in four levels A, B, C and D, and the worst result obtained in the evaluations every 1,000 prints in each environmental condition is shown in the table:

A: no density difference at all

B: slight density difference observable

C: density difference clearly observable

D: density difference observable in the 3rd or subsequent turn of the sleeve.

(3) Dot Reproducibility

In the evaluation (1), after 3,000 prints in a normal-temperature and normal-humidity environment (23° C., 60% RH), a halftone pattern of an isolated 1-dot was printed and the dot reproducibility was evaluated by visual inspection under an optical microscope, according to the following criteria:

A: sharp dot edge and almost no toner scattering around dot

B: sharp dot edges but slight toner scattering around dot

C: somewhat great toner scattering, and blurry edge

D: level lower than C

TABLE 3

| | | | developing property | | | | | | | | |
|---|---|---|---|---|---|---|---|---|---|---|---|
| | | | normal-temp. normal-humid. | | low-temp. low-humid. | | | high-temp. high-humid. | | | |
| | low-temp. | high-temp. | image density | | image density | | fog | image density | | | |
| | fixing property (° C.) | offset resistance (° C.) | Initial stage | after 10000 prints | initial stage | after 10000 prints | after 10000 prints | initial stage | after 10000 prints | ** | *** |
| Ex. 1 | 150 | none | 1.57 | 1.54 | 1.58 | 1.58 | 0.3 | 1.55 | 1.53 | A | A |
| Ex. 2 | 150 | none | 1.55 | 1.52 | 1.57 | 1.53 | 0.7 | 1.50 | 1.47 | A | A |
| Ex. 3 | 155 | 240 | 1.52 | 1.47 | 1.50 | 1.48 | 1.4 | 1.47 | 1.41 | A | B |
| Ex. 4 | 155 | 235 | 1.47 | 1.41 | 1.48 | 1.42 | 1.9 | 1.43 | 1.40 | A | B |
| Ex. 5 | 160 | 230 | 1.42 | 1.39 | 1.45 | 1.39 | 2.0 | 1.41 | 1.35 | B | B |
| Ex. 6 | 165 | 225 | 1.38 | 1.35 | 1.40 | 1.34 | 3.4 | 1.40 | 1.31 | B | C |
| Ex. 7 | 170 | 220 | 1.37 | 1.35 | 1.41 | 1.33 | 3.9 | 1.39 | 1.31 | C | C |
| Ex. 8 | 175 | 215 | 1.31 | 1.24 | 1.34 | 1.29 | 4.5 | 1.30 | 1.16 | C | C |
| Ex. 9 | 170 | 205 | 1.30 | 1.24 | 1.35 | 1.20 | 5.9 | 1.29 | 1.10 | D | C |
| Comp. Ex. 1 | 185 | 190 | 1.21 | 1.08 | 1.24 | 1.17 | 7.5 | 1.15 | 1.06 | D | D |
| Comp. Ex. 2 | 190 | 200 | 1.16 | 0.94 | 1.22 | 1.08 | 8.3 | 1.13 | 0.82 | D | D |

none: no offset occurs
**: sleeve ghost
***: dot reproducibility

This application claims priority from Japanese Patent Application No. 2005-124700 filed on Apr. 22, 2005, which is hereby incorporated by reference herein.

The invention claimed is:

1. A magnetic toner comprising magnetic toner particles containing at least a binder resin and a magnetic iron oxide, wherein the magnetic toner has a saturation magnetization σs of 5-80 $Am^2/kg$ and a residual magnetization σr of 0.1-15.0 $Am^2/kg$ in a magnetic field of 795.8 kA/m; and the binder resin includes at least a polyester component polymerized with an aromatic carboxylic acid titanium compound as a catalyst.

2. The toner according to claim 1, wherein the aromatic carboxylic acid titanium compound is obtained by reacting an aromatic carboxylic acid and a titanium alkoxide.

3. The toner according to claim 2, wherein the aromatic carboxylic acid is an aromatic carboxylic acid and/or an aromatic oxycarboxylic acid with two or more valences.

4. The toner according to claim 2, wherein the titanium alkoxide is a compound represented by the following general formula (1):

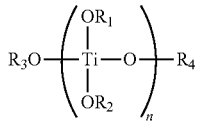

(1)

wherein $R_1$, $R_2$, $R_3$ and $R_4$ represent alkyl groups with 1-20 carbon atoms, which may be the same or different and each may have a substituent; and n represents an integer of 1 to 10.

5. The toner according to claim 1, wherein the polyester component is one obtained by polycondensation of a polyhydric alcohol and a polycarboxylic acid, and the carboxylic acid component contains an aromatic dicarboxylic acid in an amount of 50 mol. % or more based on all the carboxylic acid components.

6. The toner according to claim 1, wherein the magnetic toner having a circle-equivalent diameter of 3 to 400 μm as measured with a flow-type particle image analyzer has an average circularity of from 0.935 or more to less than 0.995 and the magnetic toner has an average surface roughness of from 10.0 nm or more to less than 26.0 nm as measured with a scanning probe microscope.

* * * * *